US007222601B1

(12) United States Patent
Kamenov

(10) Patent No.: US 7,222,601 B1
(45) Date of Patent: May 29, 2007

(54) ROTARY VALVELESS INTERNAL COMBUSTION ENGINE

(76) Inventor: Kamen George Kamenov, 2470 Fulton St. #5, San Francisco, CA (US) 94118

( * ) Notice: Subject to any disclaimer, the term of this patent is extended or adjusted under 35 U.S.C. 154(b) by 0 days.

(21) Appl. No.: 11/176,899

(22) Filed: Jul. 8, 2005

(51) Int. Cl.

| | |
|---|---|
| ***F02B 53/00*** | (2006.01) |
| ***F02B 75/00*** | (2006.01) |
| ***F01C 1/07*** | (2006.01) |
| ***F01C 9/00*** | (2006.01) |
| ***F01C 1/063*** | (2006.01) |
| ***F01C 1/00*** | (2006.01) |
| ***F04C 18/00*** | (2006.01) |
| ***F04C 2/00*** | (2006.01) |

(52) U.S. Cl. ..... 123/245; 123/18 R; 123/241; 418/34; 418/36; 418/38

(58) Field of Classification Search ..... 123/18 R, 123/18 A, 245, 241; 73/260; 418/35–38
See application file for complete search history.

(56) References Cited

U.S. PATENT DOCUMENTS

| | | | | |
|---|---|---|---|---|
| 967,097 | A | 8/1910 | Woodward | 123/18 R |
| 1,010,583 | A | 12/1911 | Carmichael | 123/18 R |
| 1,037,094 | A | 8/1912 | Williams | 123/18 R |
| 1,346,805 | A | 7/1920 | Barber | 123/18 R |
| 1,388,438 | A * | 8/1921 | Nollmann | 418/108 |
| 1,946,136 | A * | 2/1934 | Farley | 418/36 |
| 3,565,049 | A | 2/1971 | Bauer | 418/36 |
| 3,769,946 | A * | 11/1973 | Scherrer | 418/36 |
| 3,985,110 | A | 10/1976 | Doundoulakis | 418/36 |
| 4,010,719 | A * | 3/1977 | Lappa | 123/18 R |
| 4,027,475 | A * | 6/1977 | Folsom | 123/18 R |
| 4,068,985 | A * | 1/1978 | Baer | 418/36 |
| 4,136,661 | A | 1/1979 | Posson | 418/36 |
| 4,153,396 | A * | 5/1979 | Landry | 418/38 |
| 4,169,697 | A * | 10/1979 | Doundoulakis | 418/34 |
| 4,599,976 | A | 7/1986 | Meuret | 123/18 R |
| 4,884,532 | A | 12/1989 | Tan | 123/18 R |
| 5,086,732 | A * | 2/1992 | Seno | 123/18 R |
| 5,501,070 | A * | 3/1996 | Lin | 418/34 |
| 5,569,027 | A * | 10/1996 | Ball et al. | 418/35 |
| 6,461,127 | B1 | 10/2002 | Kim | 418/36 |
| 6,886,527 | B2 * | 5/2005 | Regev | 123/245 |
| 7,156,068 | B2 * | 1/2007 | Yuskel | 123/245 |

FOREIGN PATENT DOCUMENTS

| | | | |
|---|---|---|---|
| DE | 3137979 | A1 * | 4/1983 |

(Continued)

*Primary Examiner*—Thai-Ba Trieu

(57) ABSTRACT

A rotatably alternating air or water cooled two-stroke internal combustion engine comprising a cylindrical casing, and a rotor comprising two radially extending vanes affixed to a shaft rotatably mounted within the casing upon two end plates. Two longitudinally extending walls affixed to the casing. Sealing strips provided between said walls, the shaft, the vanes, the casing and the end plates respectively. The casing and/or the end plates equipped with plurality of ports which communicate with interior chambers formed between the vanes and the walls, allowing for intake of combustible air-fuel mixture and exhaust thereafter. Ignition means delivering a spark at the end of each working cycle. An extendable and adjustable connecting rod assembly converting the oscillating bi-directional rotary motion of the output shaft into a continuous unidirectional motion of the main shaft. A self lubricating mechanism incorporated into the engine.

8 Claims, 35 Drawing Sheets

FOREIGN PATENT DOCUMENTS

| | | | | |
|---|---|---|---|---|
| DE | 3725277 | A1 | * | 2/1989 |
| DE | 3824539 | A1 | * | 2/1990 |
| EP | 575309 | A1 | * | 12/1993 |
| FR | 447632 | | * | 1/1913 |
| WO | WO 8606786 | A1 | * | 11/1986 |
| WO | WO 9001676 | A1 | * | 2/1990 |

* cited by examiner $R_2 > R_1$ , $\varphi_2 > \varphi_1$ 31a
31

2
16
15
b1
30
30
a
b
14
14
7
8
14a
14b
d1
15
d
c
1
15ab
3
18
29

ROTARY VALVELESS INTERNAL COMBUSTION ENGINE

BACKGROUND OF THE INVENTION

This invention is related to application Ser. No. 10/762,783, with a filing date 01/23/2004, now abandoned.

This invention relates to a rotatively reciprocating vane internal combustion engine having few moving parts, high efficiency, and a low weight-to-power ratio.

In an age of environmental concerns and waning natural resources, a lightweight, highly efficient, low fuel consumption engine has been vigorously sought.

In the past, attempts have been made to improve on reciprocating piston engines but their inherent complexity and high weight-to-power ratio has proven limiting. Also rotary or Wankel design engines have become relatively highly developed, they still exhibit daunting problems in rotor sealing and cost parameters. For example, the Wankel engine is difficult to manufacture, it has a short life, it has a problem of loosing its lubrication and seizing up. It has poor gas mileage, high oil consumption and high exhaust level. For every three turns of the working piston there is only one rotation of the main power output shaft which results in an excessive friction inside the working chamber between the piston and the casing.

Some attempts have been made to provide rotary vane engines, which abate some of the aforementioned problems. For example, U.S. Pat. No. 4,599,976 to Meuret discloses the utilization of spherically shaped chamber and accordingly shaped vanes, which are used to sequentially compress and expand a combustive mixture. It should be noted, however, that the patented system has the following disadvantages.

In Meuret patent the ratio between the volume of the chamber and the diameter of the vanes is constant. If the volume of the sphere chamber changes it automatically and proportionally changes the radius of the vanes. In a cylindrical chamber the volume of the chamber can be changed either by simply changing the length of the cylinder or by changing the radius of the cylinder. In each case there is going to be a different output even thought the volume is the same. A cylindrical engine is much easier to manufacture and seal, and to open and repair.

Another example of a prior art attempt to overcome some of the disadvantages of existing engines is the U.S. Pat. No. 4,884,532 to Tan, which teaches an extremely complex swinging piston internal combustion engine. While Tan has made certain admirable advantages, his device suffers from the following disadvantages.

The Tan engine is big and bulky. There is no power-to-weight ratio advantage over the conventional engine. It would be difficult to manufacture and repair it. It would be difficult to balance it and it would only work as a diesel engine.

A further example of a prior art attempt is the U.S. Pat. No. 1,346,805 issued to Barber. Barber discloses a rotatably reciprocating vane internal combustion engine comprising: a water jacketed, double-walled cylindrical casing allowing for cooling fluid to pass through it; the casing equipped with longitudinally extending walls affixed to it; vanes affixed to a shaft rotatably alternating in back and forth fashion; the shaft mounted upon double-walled end plates; four working chambers inside the casing, each chamber experiencing an intake, a compression, an ignition-expanding and lastly an exhaust cycle; four sets of ports, each set for intake of combustible fluid and exhaust thereafter; and four ignition means, one for each chamber.

However, Barber engine is a four stroke engine only. Barber fails to disclose ports for intake of combustible fluid and lubricating oil, seal strips and external valving means with an appropriate cam shaft.

Unlike the prior art systems, the present invention provides essentially only one moving element, its rotably reciprocating vane piston. Because of pressure balancing on opposite sides of the vane members they may be constructed of lightweight material and the need for heavy bearing and counter-balancing means are virtually eliminated. The invention is capable of running on multiple types of conventionally available fuel and may conceivably be operated on four chamber two stroke cycles, two chamber two stroke cycles, one chamber two stroke cycles, or diesel cycles.

SUMMARY AND OBJECTS OF THE INVENTION

The instant rotating vane engine comprises a simple rotary vane assemblage mounted within a cylindrical housing having a fixed abutment wall and means for the intake and exhaust of combustible mixture. Primary engine valving is accomplished by simple ports of apertures in the cylindrical housing and, or the end plates or heads for the housing and by the reciprocating motion of the vane assemblage which opens and closes the apertures at the appropriate moment. The bi-directional rotation of the output shaft, upon which the vanes are mounted, may be made uni-directional by well-known external gearing system.

The primary object of the present invention is to provide a rotary internal combustion engine, which quickly, efficiently and economically converts thermal energy into usable kinetic energy.

A further object of the present invention is to provide a power plant with essentially one moving element with concomitant savings in materials, weight, labor and manufacturing costs.

A further object of the present invention is to provide a rotary engine with operating vane wherein the forces on opposite sides of the vanes are essentially balanced and the vibrations are virtually eliminated.

Other objects and advantages of the present invention will become apparent from the following drawings and description.

The accompanying drawings show, by way of illustration, the preferred embodiments of the present invention and the principles of operation therefor. It should be recognized that other embodiments of the invention, applying the same or equivalent principles, may be utilized and structural changes may be made as desired by those skilled in the art, without departing from the spirit of the invention.

Figure 3:
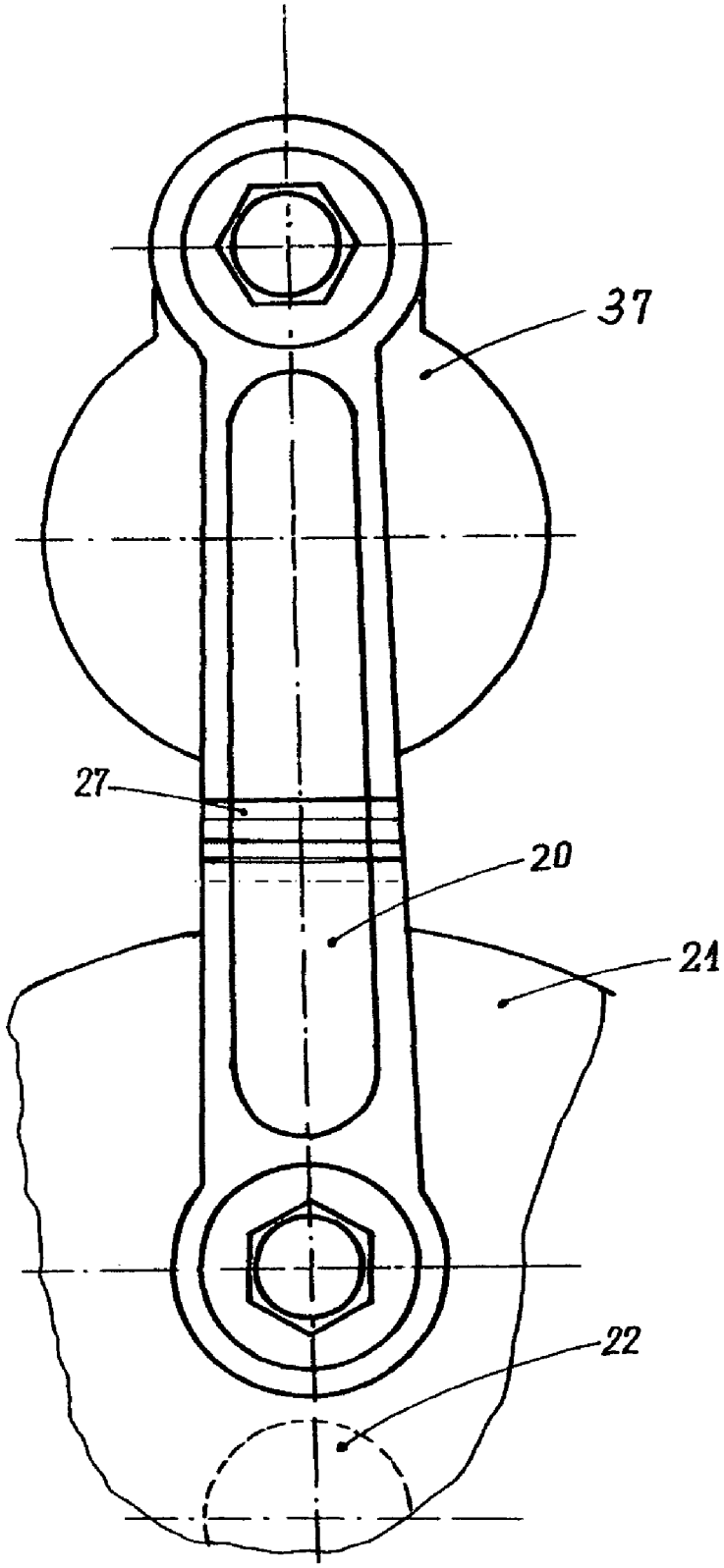
FIG. 3 shows a front view of an alternative connecting rod assembly converting the alternating bi-directional rotary motion of the swinging piston output shaft 6 into a continuous unidirectional rotary motion of the main shaft 22 (FIG.
Figure 4:
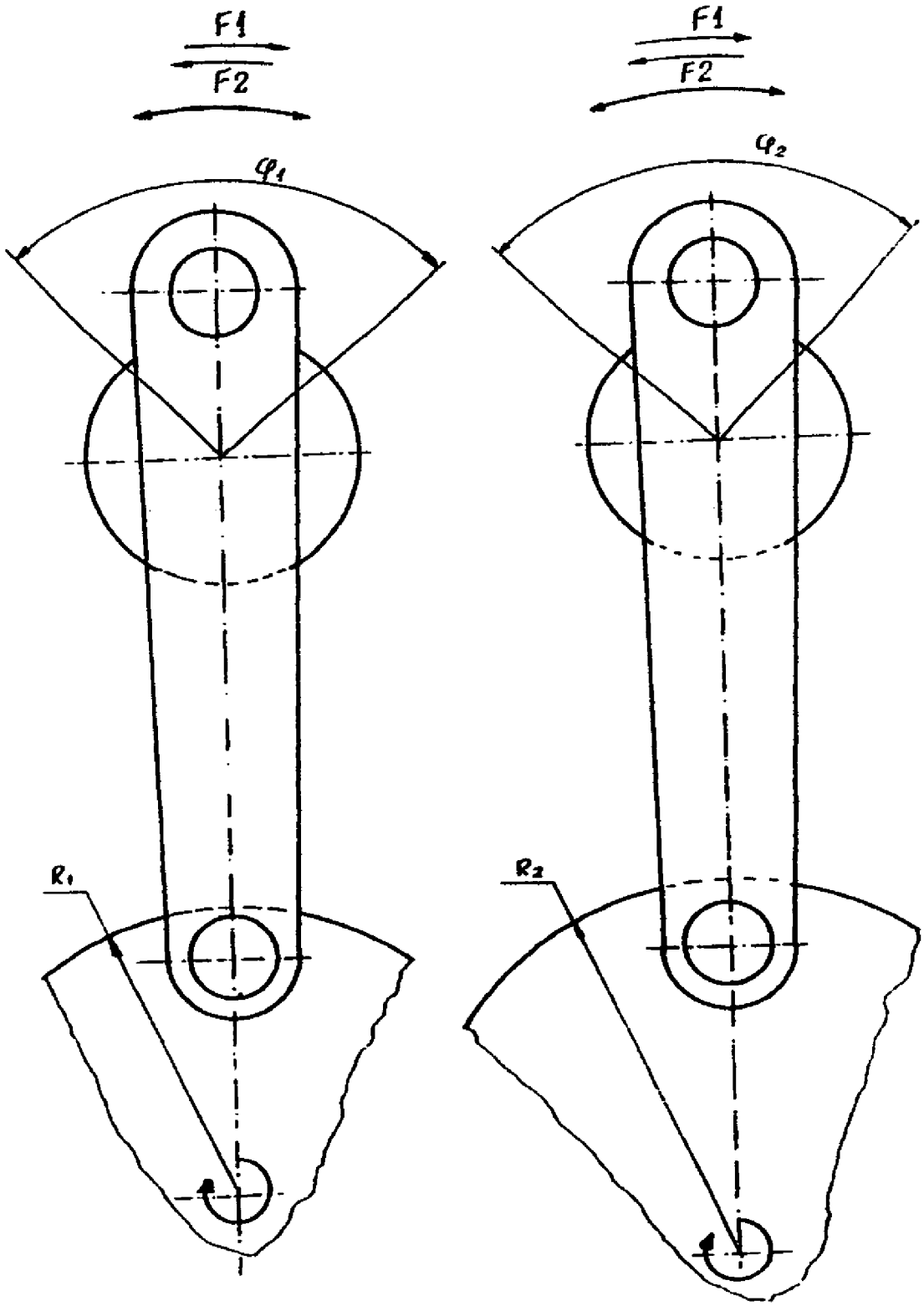
Figure 5:
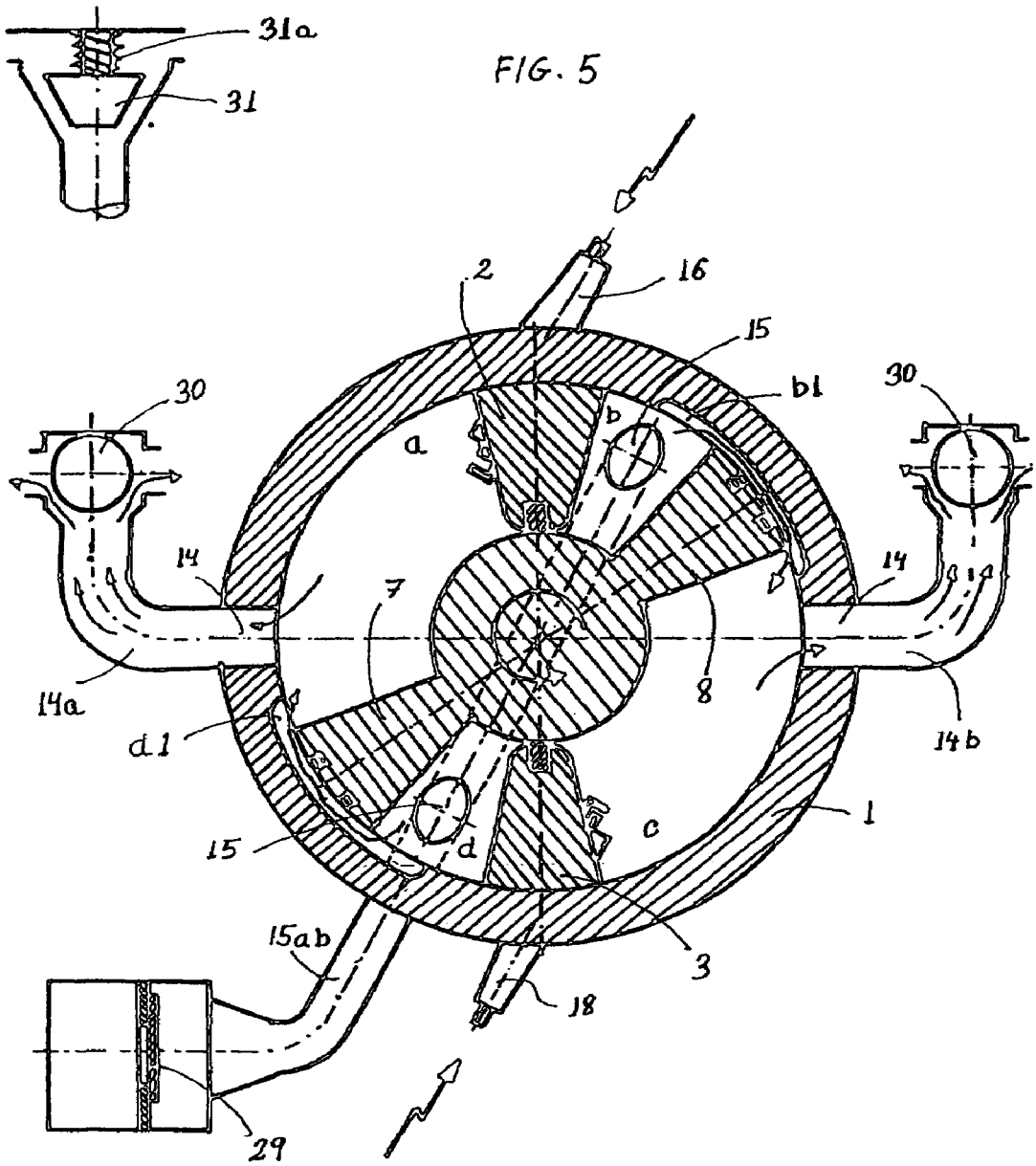
Figure 6:
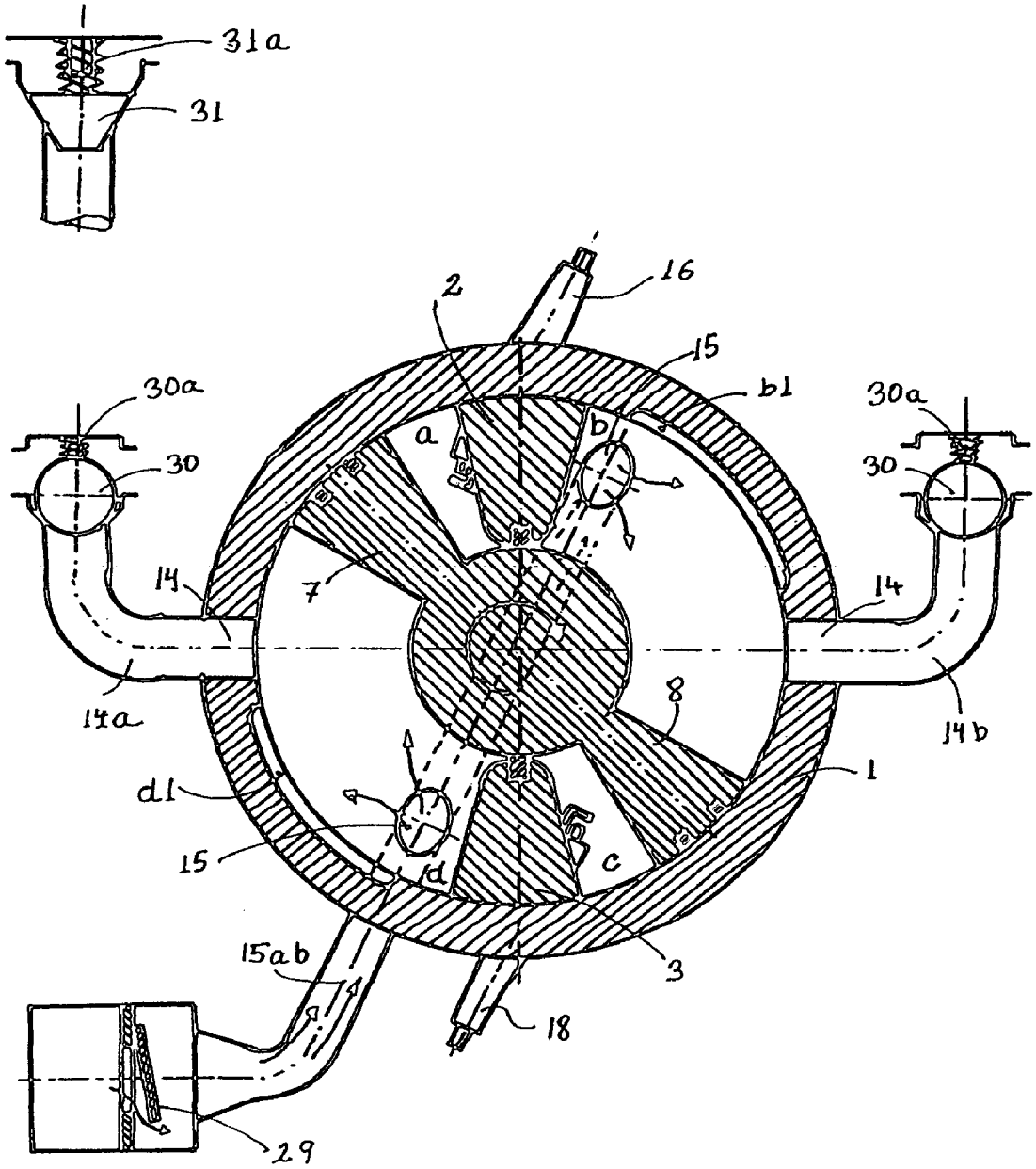
Figure 7:
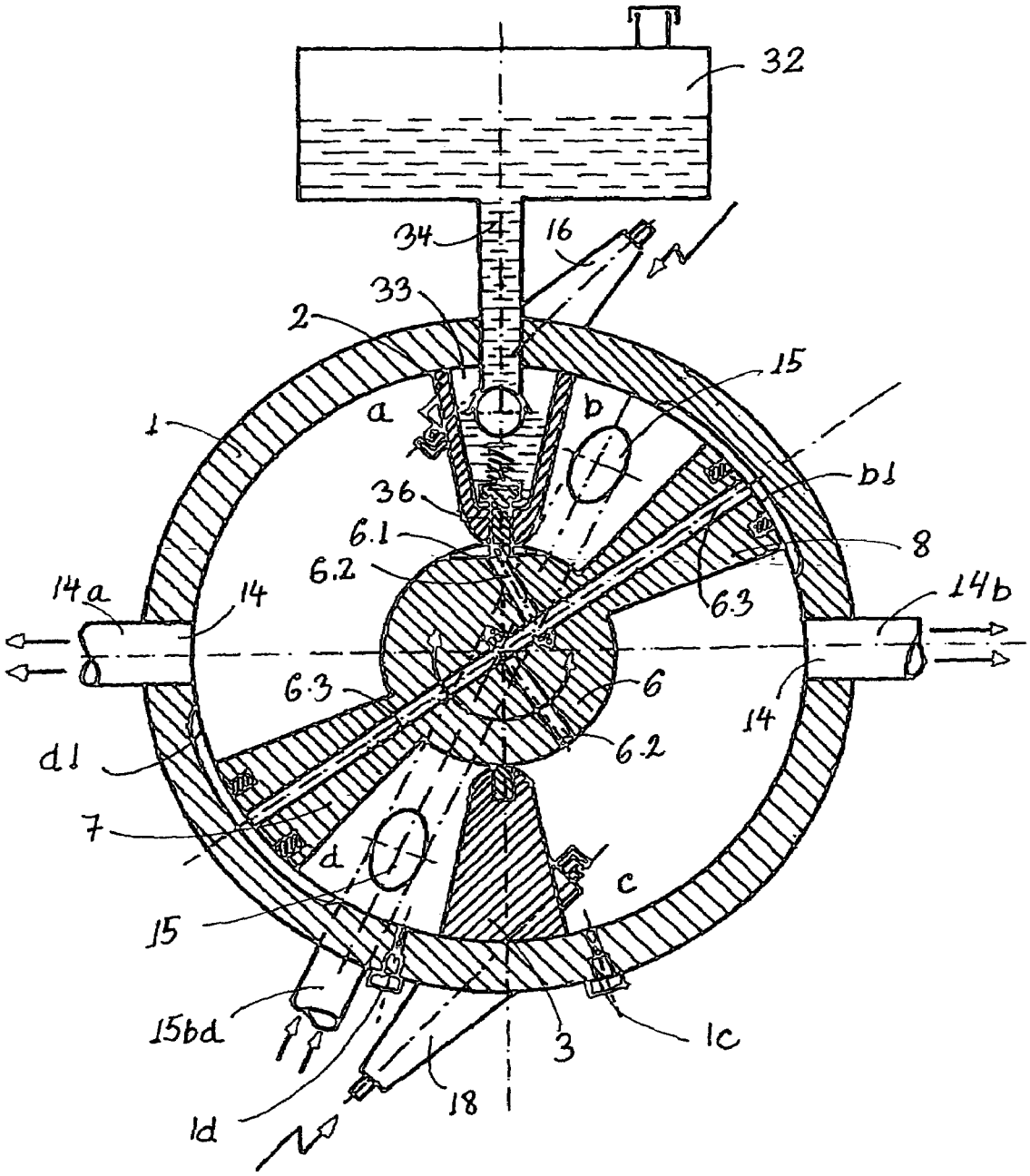
Figure 34:
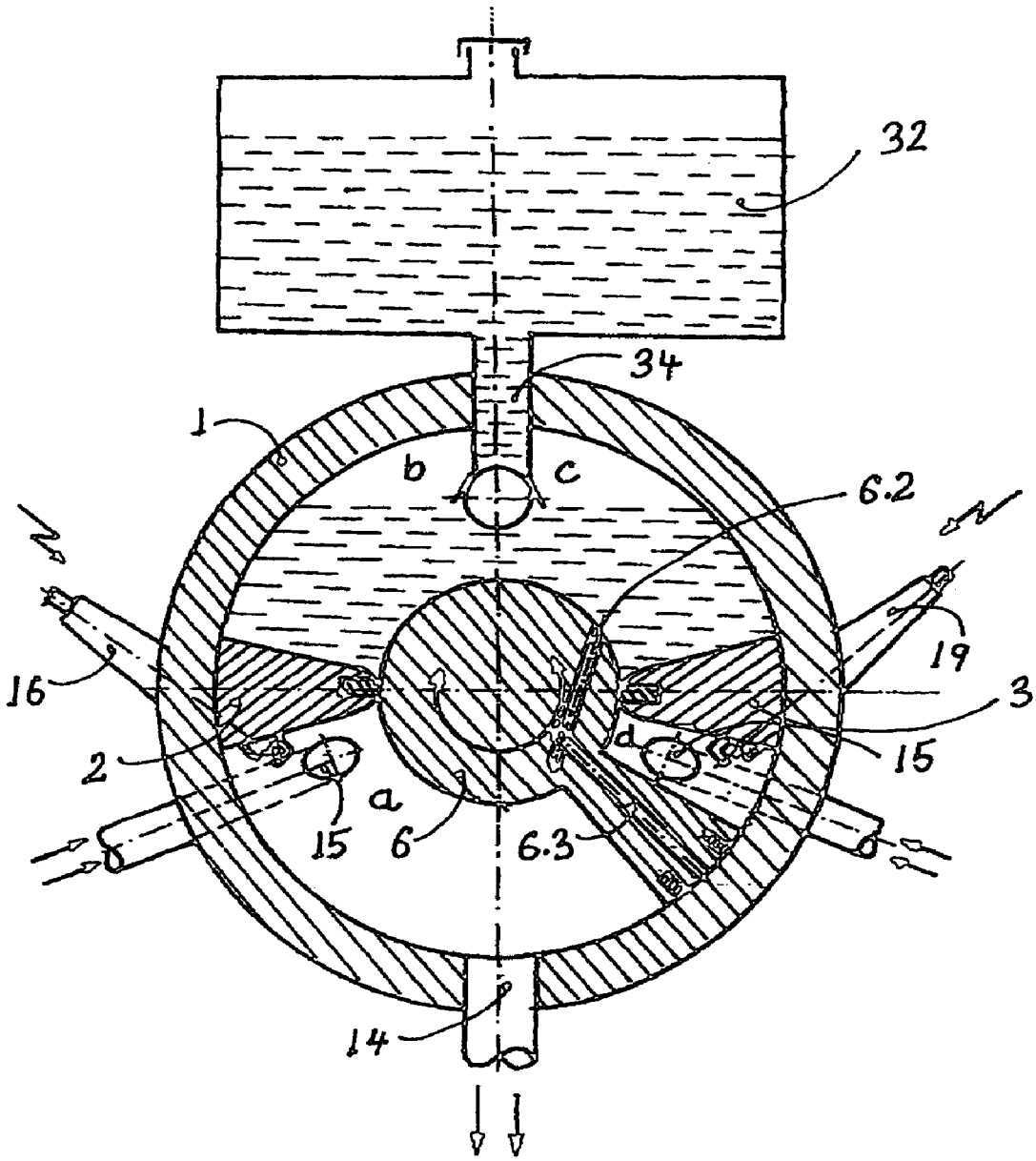

2). The break in the rod at 27 allows for extending and adjusting the length of the rod according to the desired compression inside the working chambers thus regulating the length of the stroke without the need of replacing the rod. The lower part of said rod is rotatably attached to the flywheel via a slot on that flywheel and is affixed to it with a fastening member comprising a bolt and a nut;

FIG. 4 shows schematically the relation of the length of the radius $R_1$ or $R_2$ formed between the center of the main shaft 22 (FIG. 3) and the lower end attachment of the crank pin 20 (FIG. 3) to the changing volume of the four chambers a, b, c and d (FIG. 1) formed by the swinging piston 6 (FIG. 1) inside the main cylinder of the engine, in operation. A shorter crank pin creates a longer radius and causes the swinging piston 6 to increase its rotational angle allowing for a longer stroke thus instantly creating a higher compression inside the working chambers;

On FIG. 5 there are only two chambers in operation, two spark plugs, a couple of intake ports and a couple of exhaust ports. The intake ports are connected together via a tube 15*ab* to a membrane 29 which opens and closes the tube. The exhaust ports are connected at the end to balls 30 or conical members 31 which open and close those ports. There are two cavities b1 & d1 on the inside of the cylinder's walls which allow the combustible mixture to move from the supporting chambers into the working chambers when the swinging piston is in motion. The cavities may be open as in FIGS. 5 & 6 or partially covered or bridged (FIG. 34);

FIG. 6 is identical to FIG. 5 except that the engine is in a compression stroke, membrane 29 is open for the intake ports and the balls 30 or the conical members 31 are closed for the exhaust ports;

FIG. 7 show the configuration of the engine of FIGS. 5 & 6 comprising two working chambers (a & c) and a self lubricating mechanism on the top of the engine and inside the wall 2. There are two openings (1*c* & 1*d*) on the bottom of the cylinder, normally closed with screws enabling the drainage of excessive oil when removed, or allowing a regular oil change.

Figure 8:
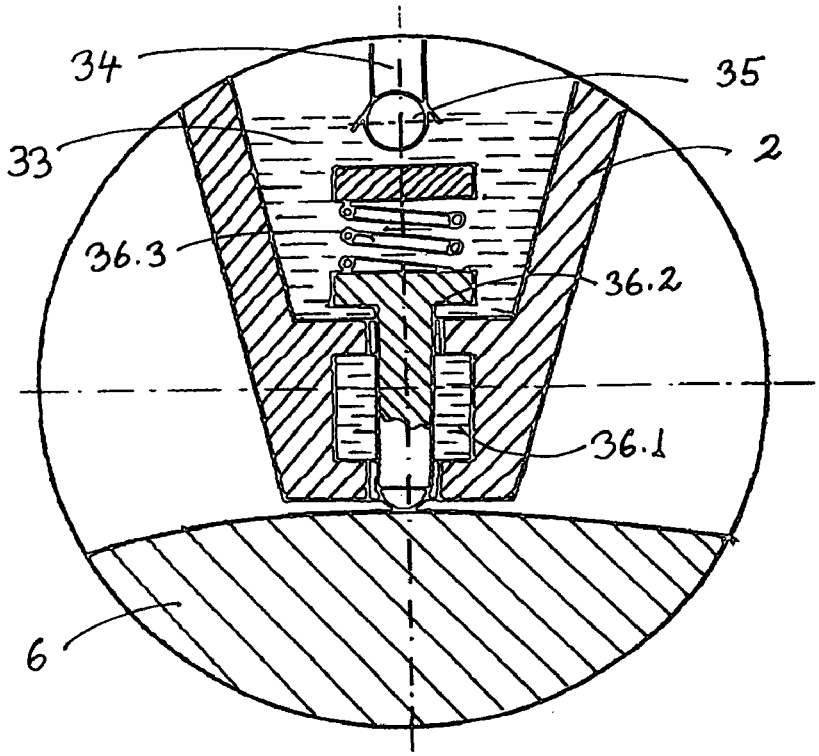
Figure 9:
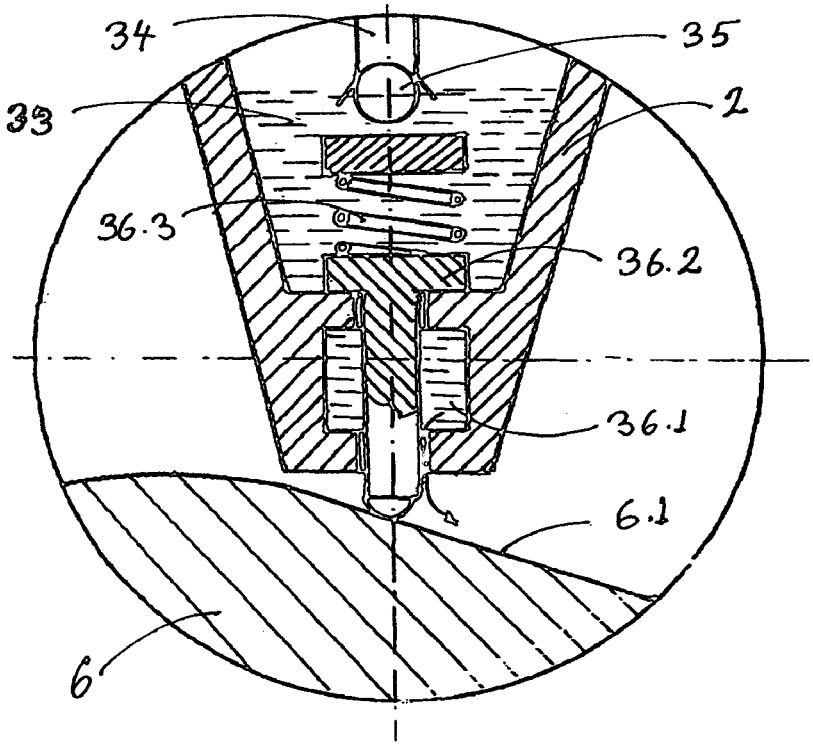
Figure 10:
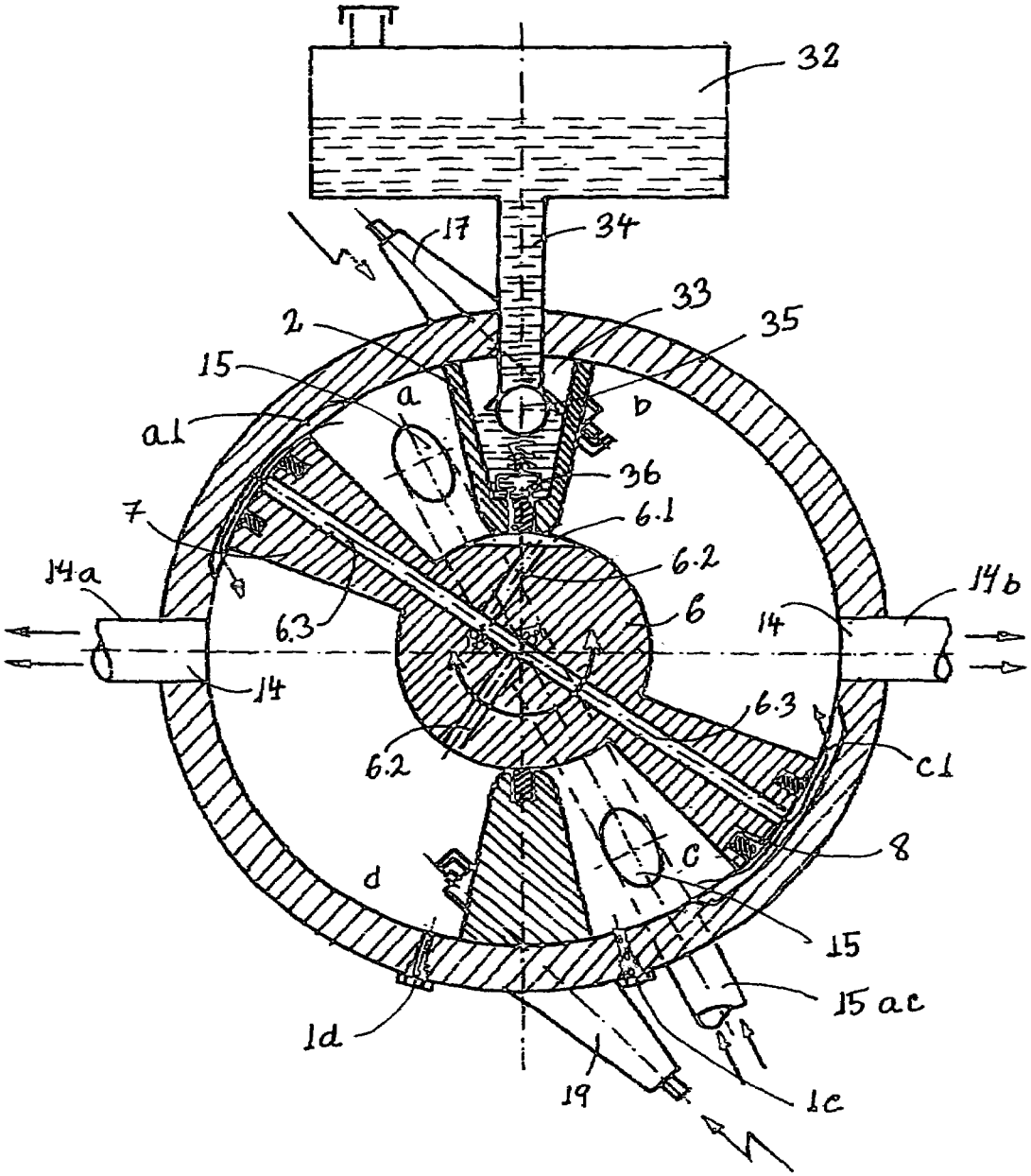
Figure 11:
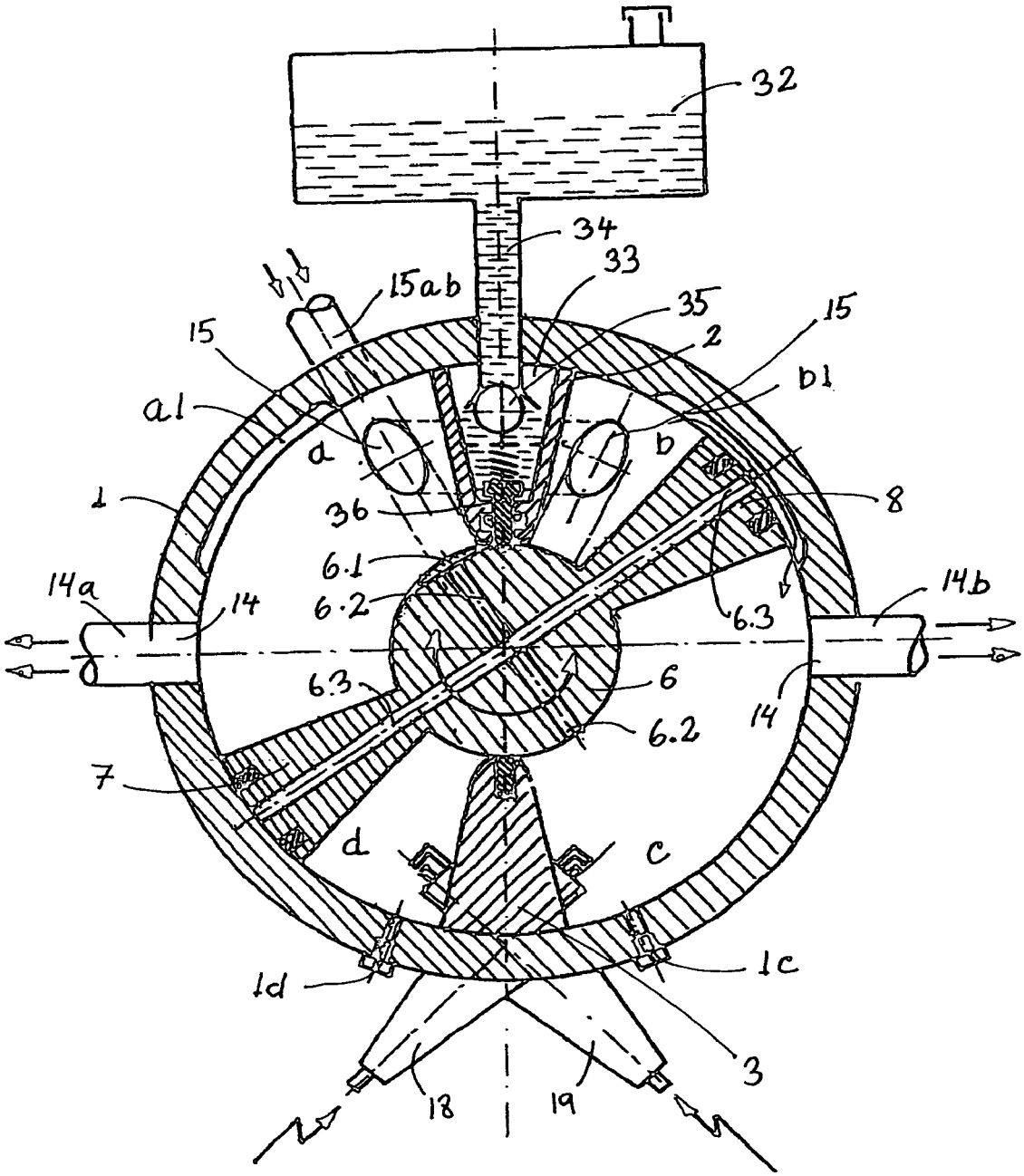
Figure 12:
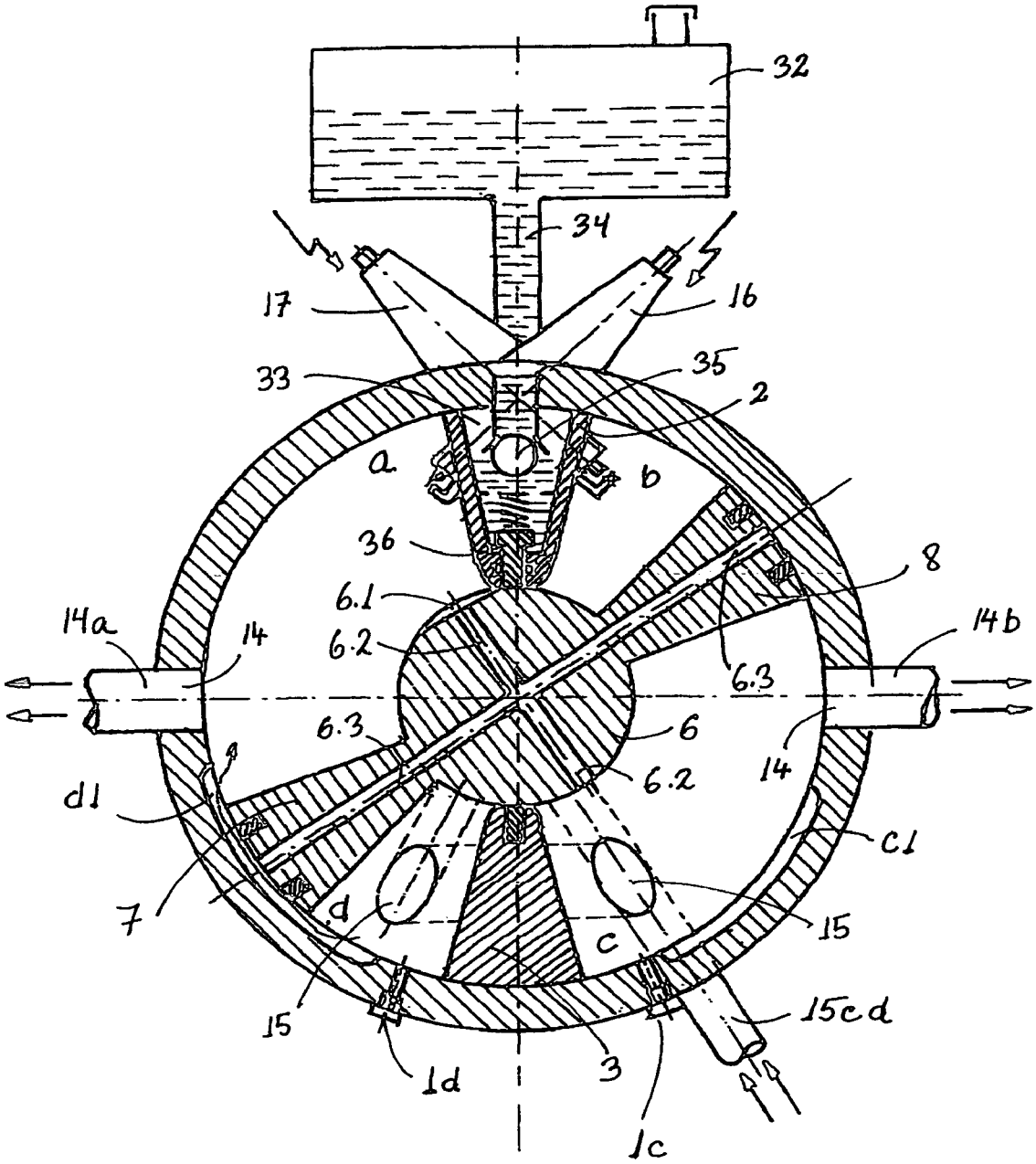
Figure 13:
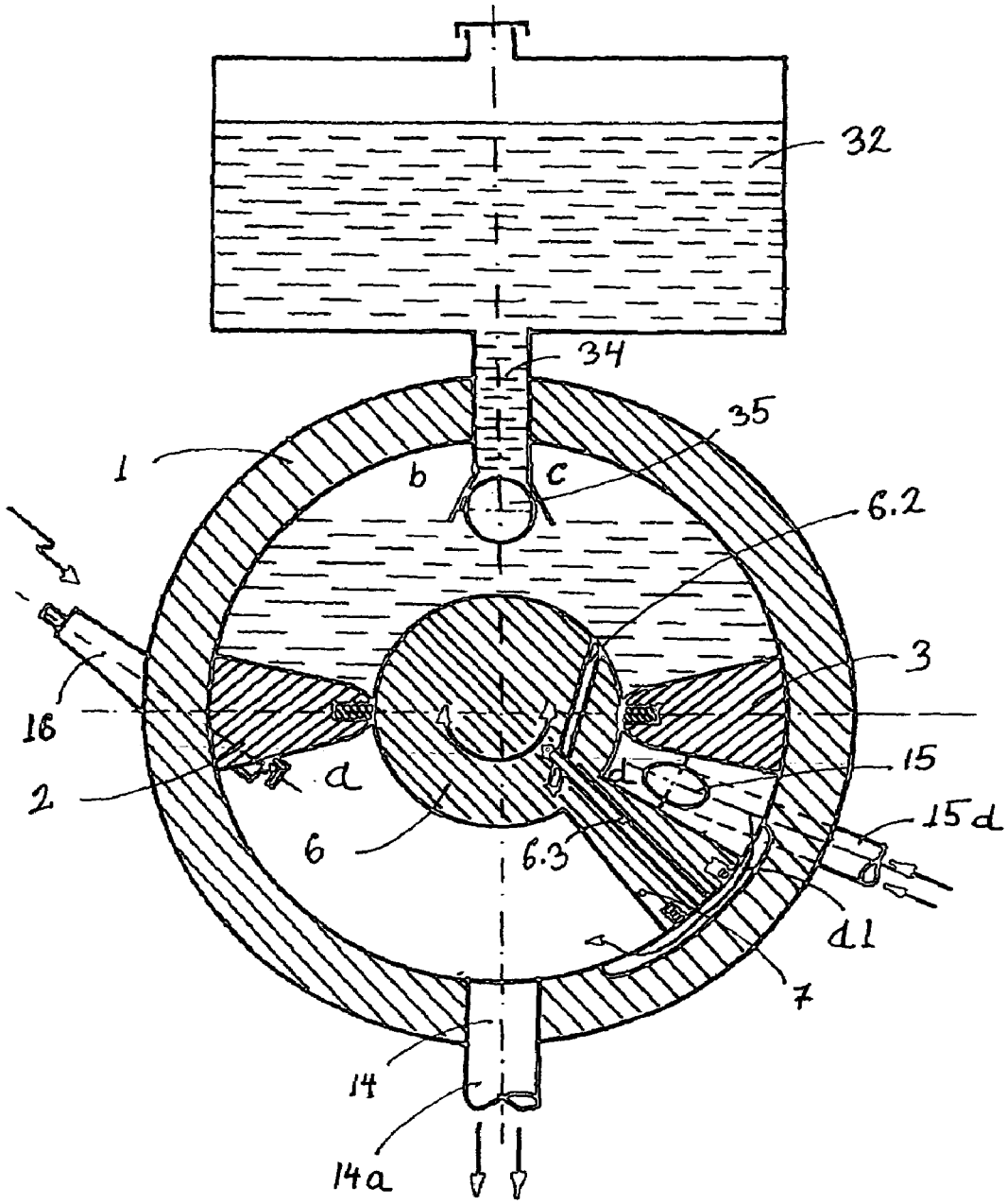
Figure 14:
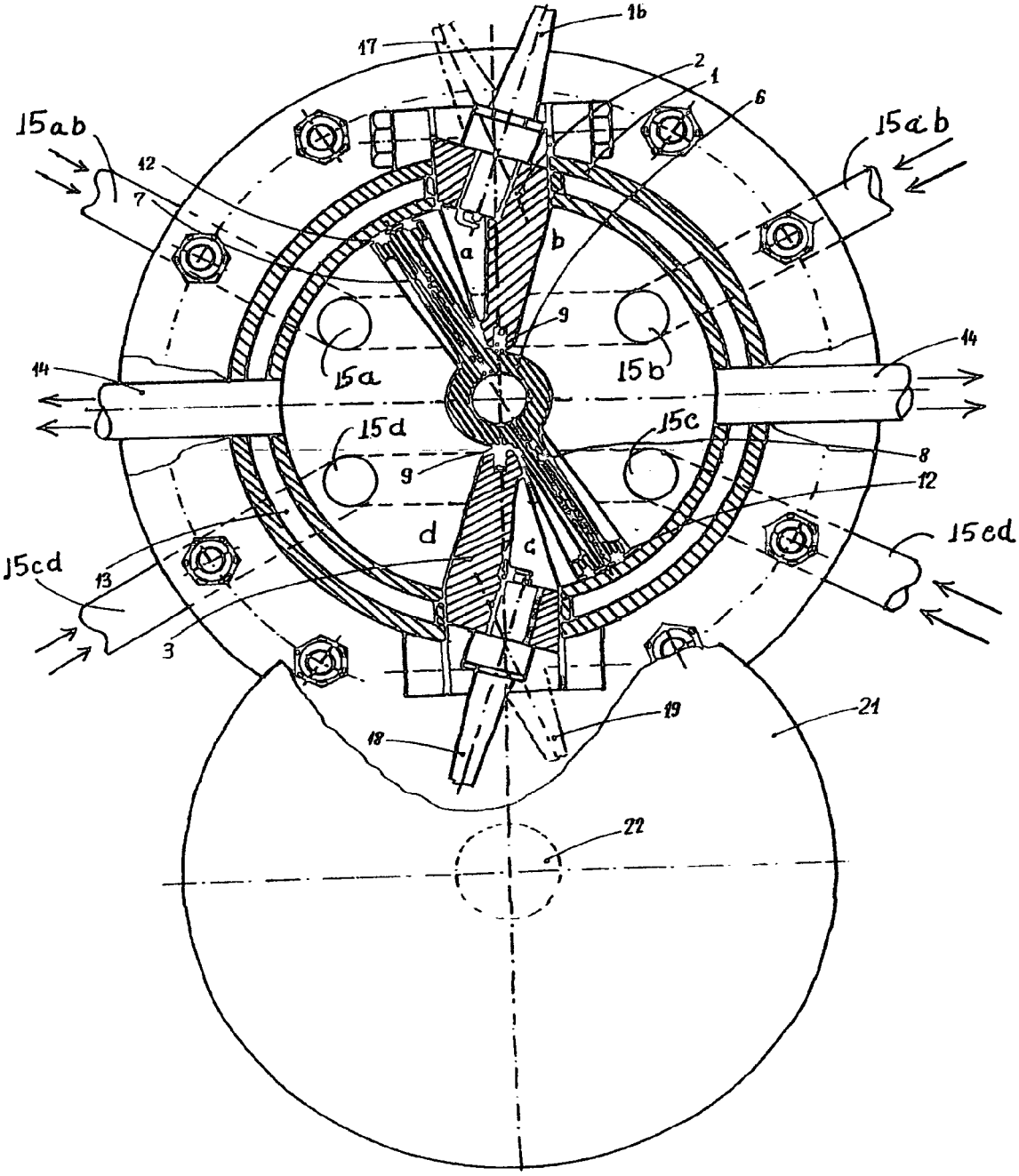
Figure 15:
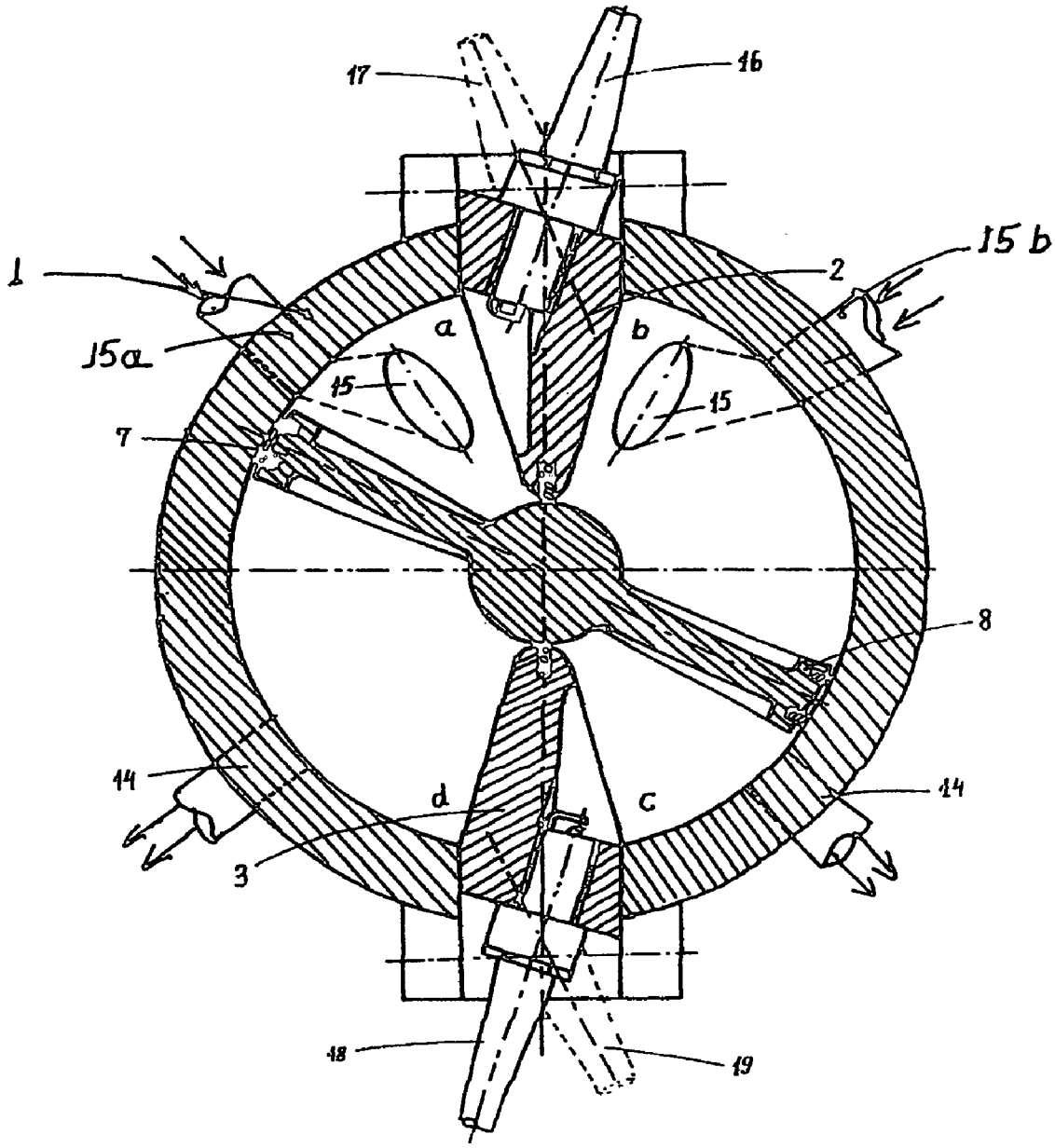
Figure 16:
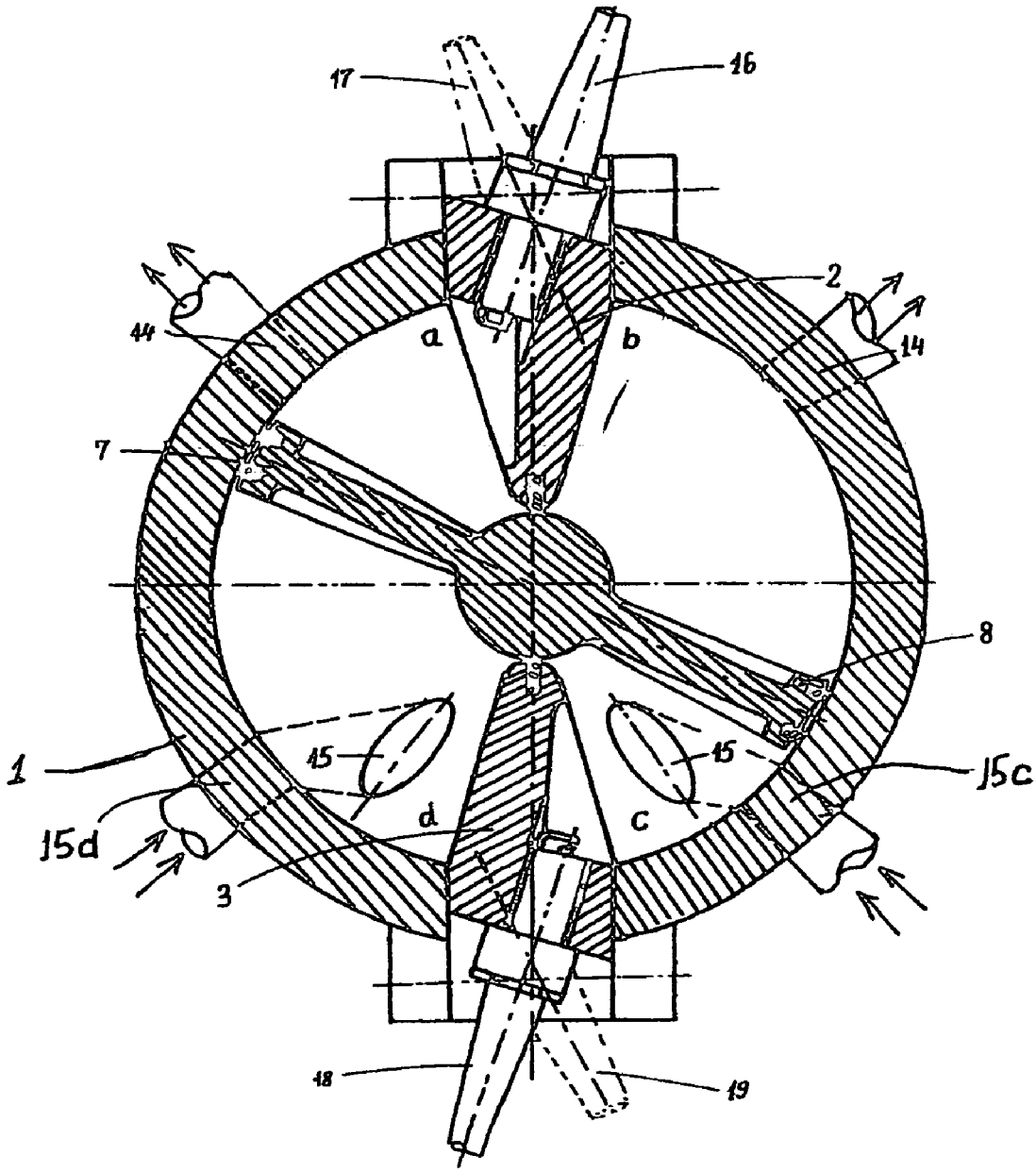
Figure 17:
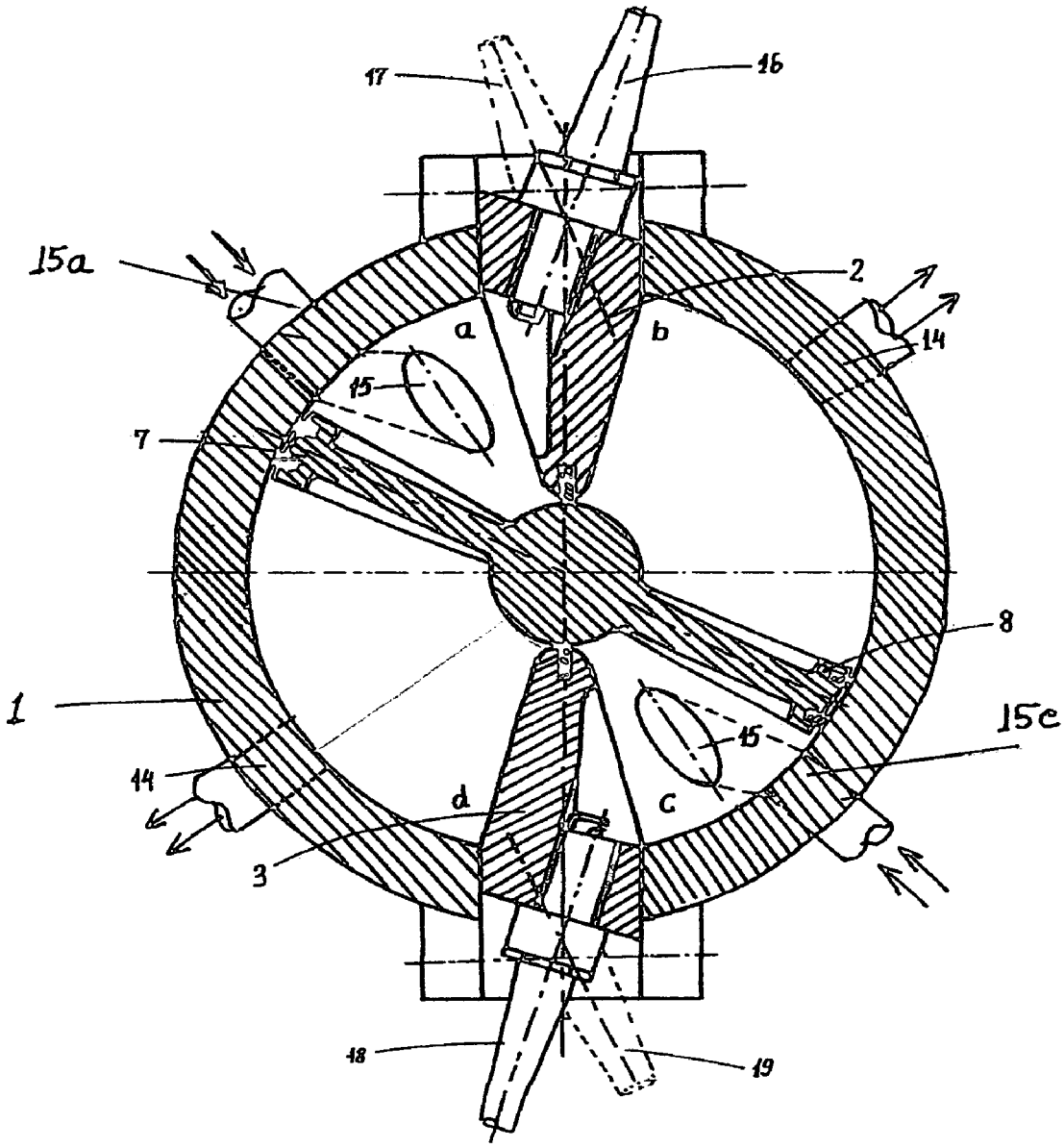
Figure 18:
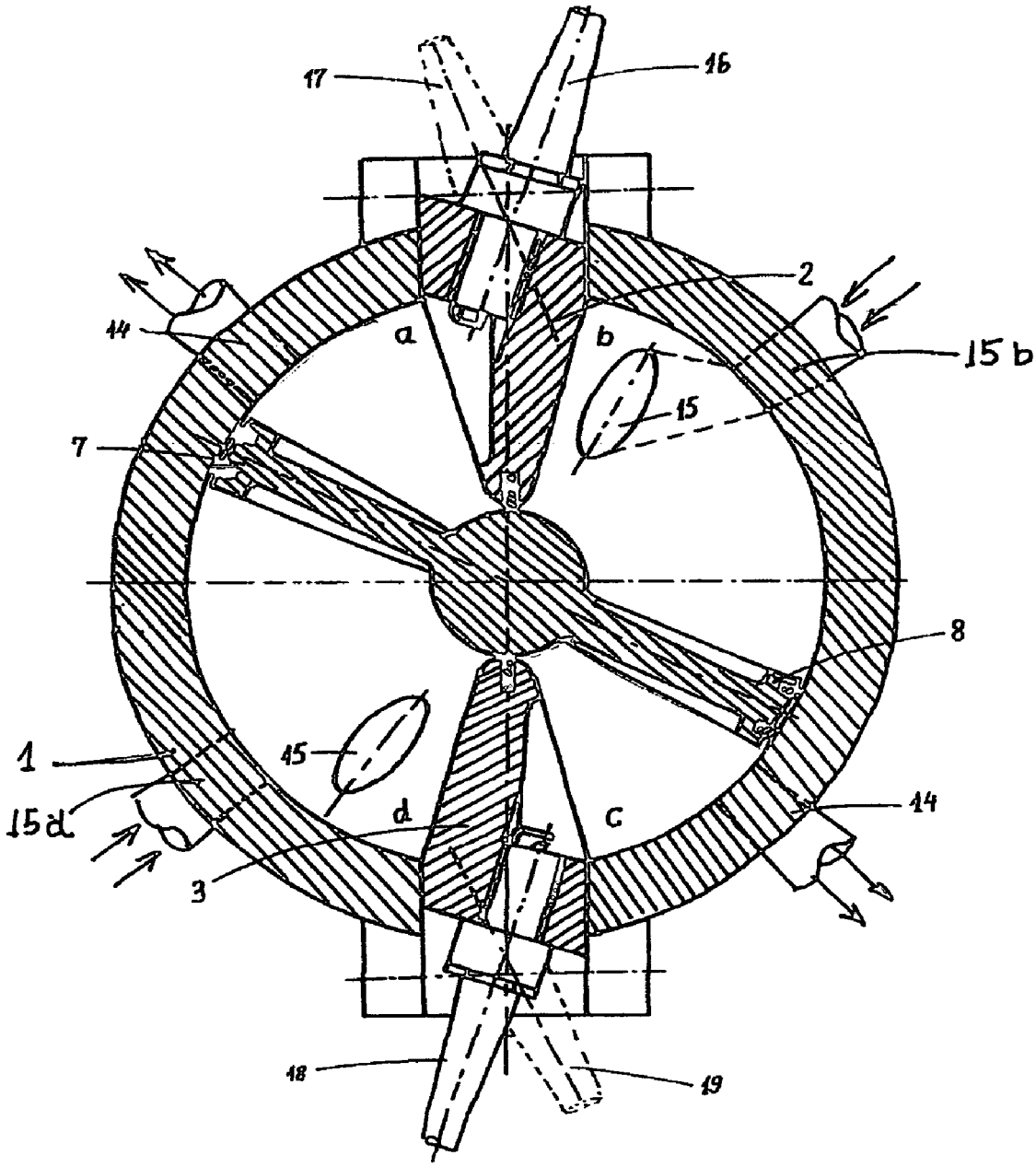
Figure 19:
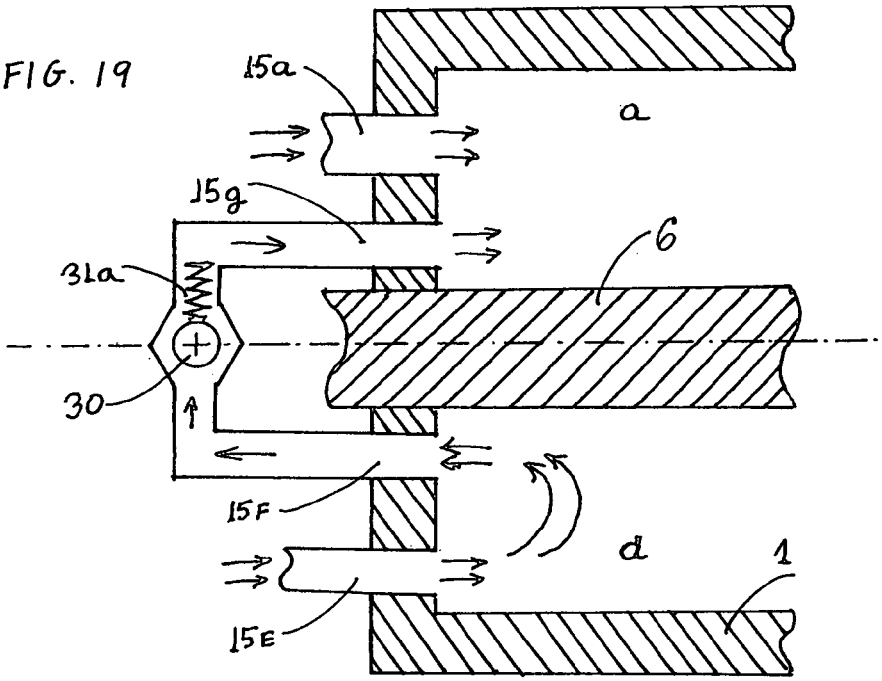
Figure 20:
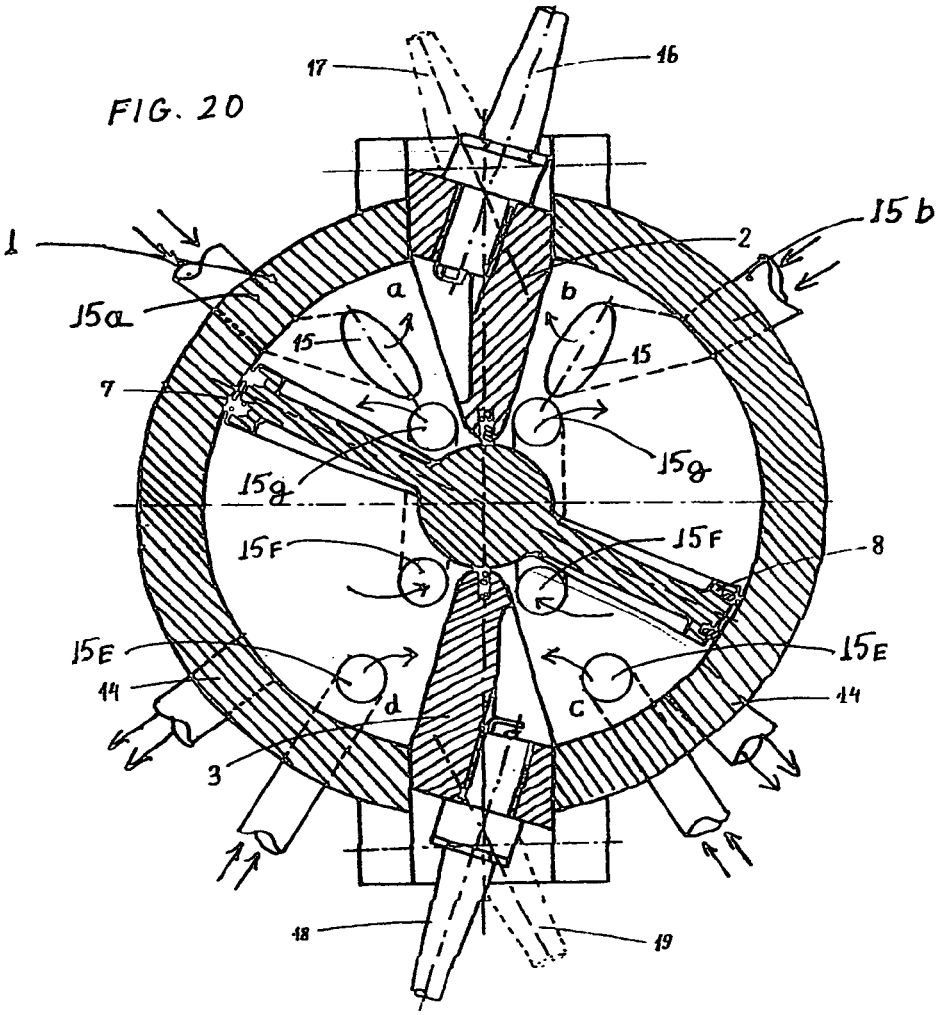
Figure 21:
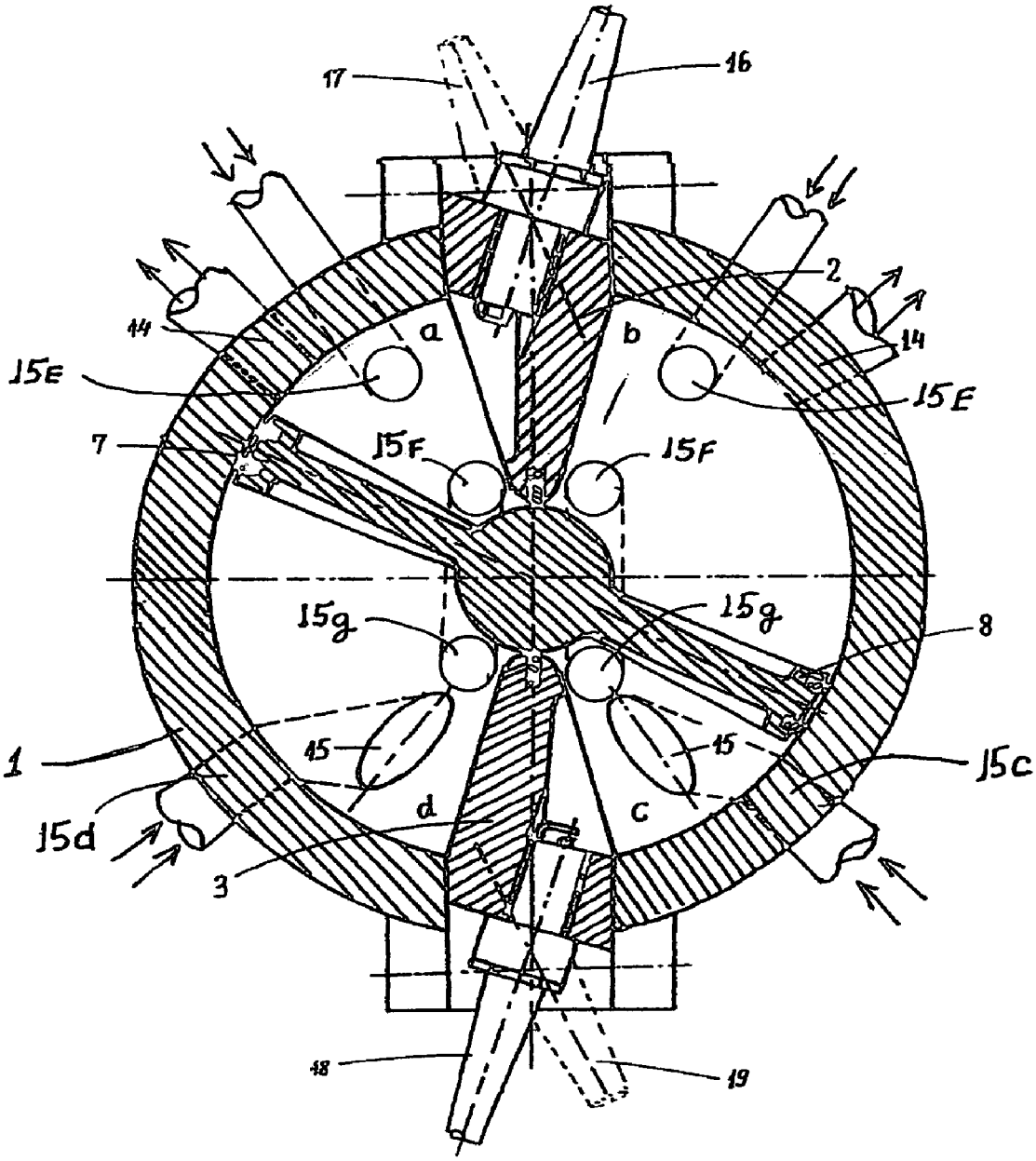
Figure 22:
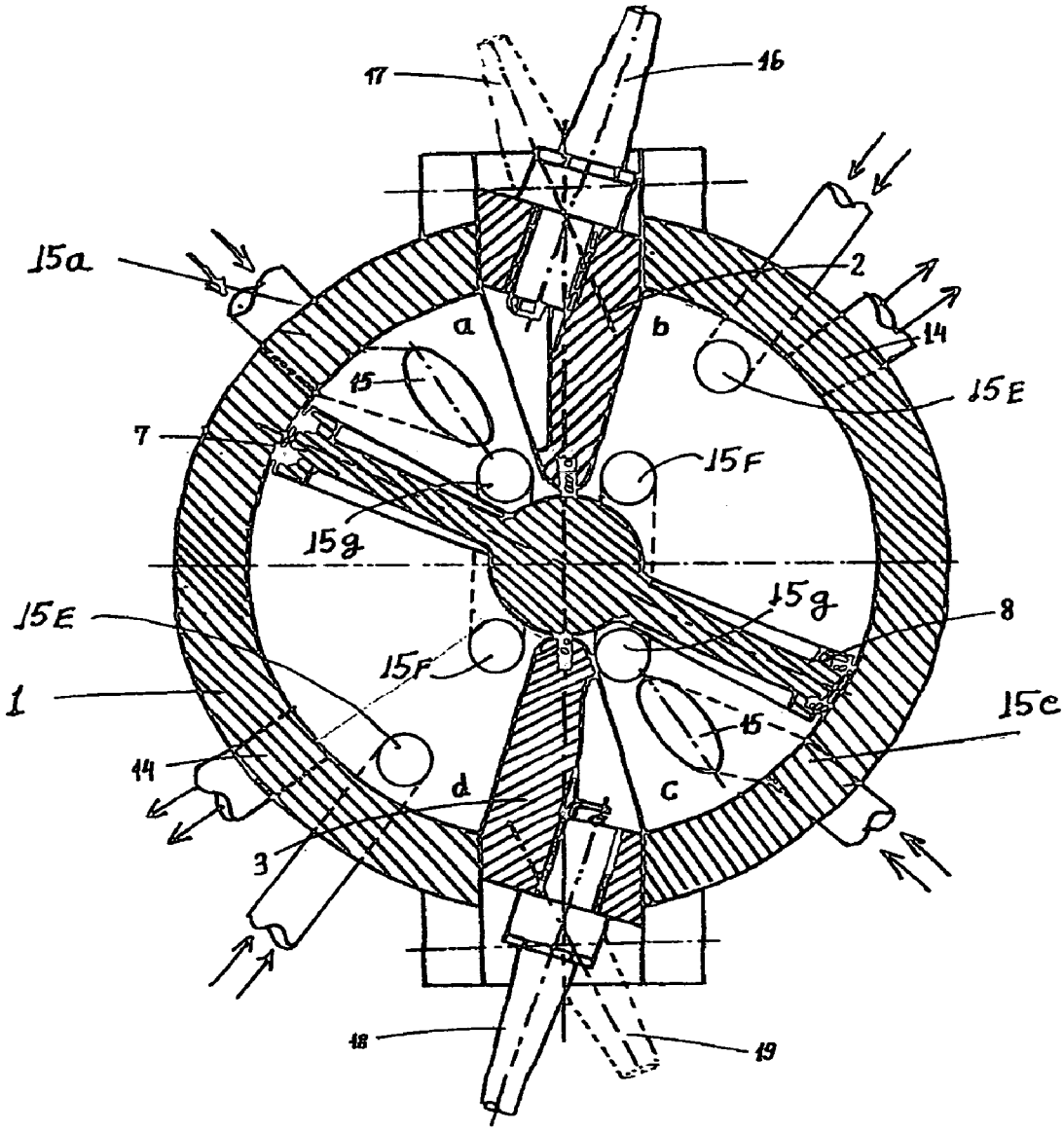
Figure 23:
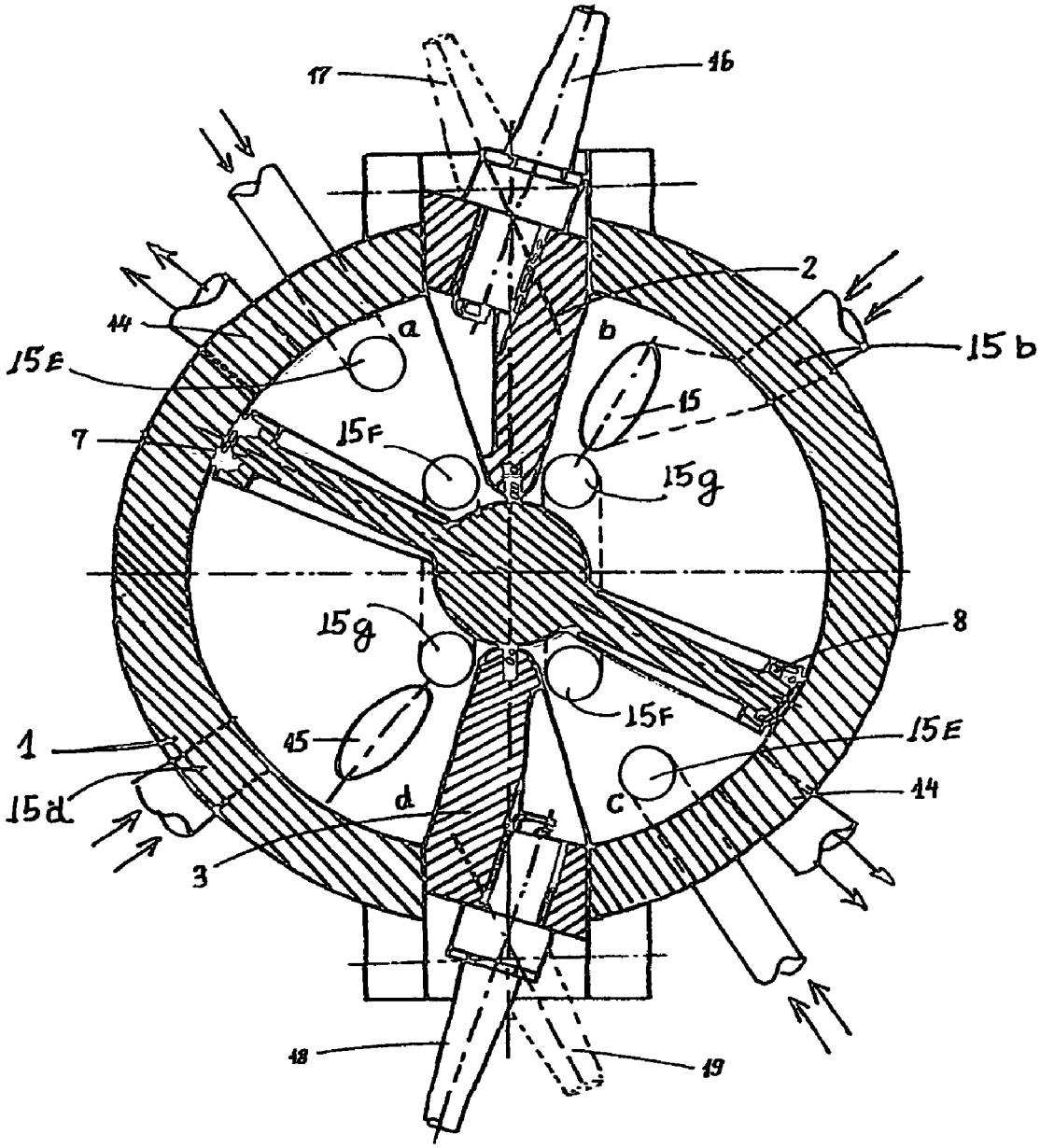
Figure 24:
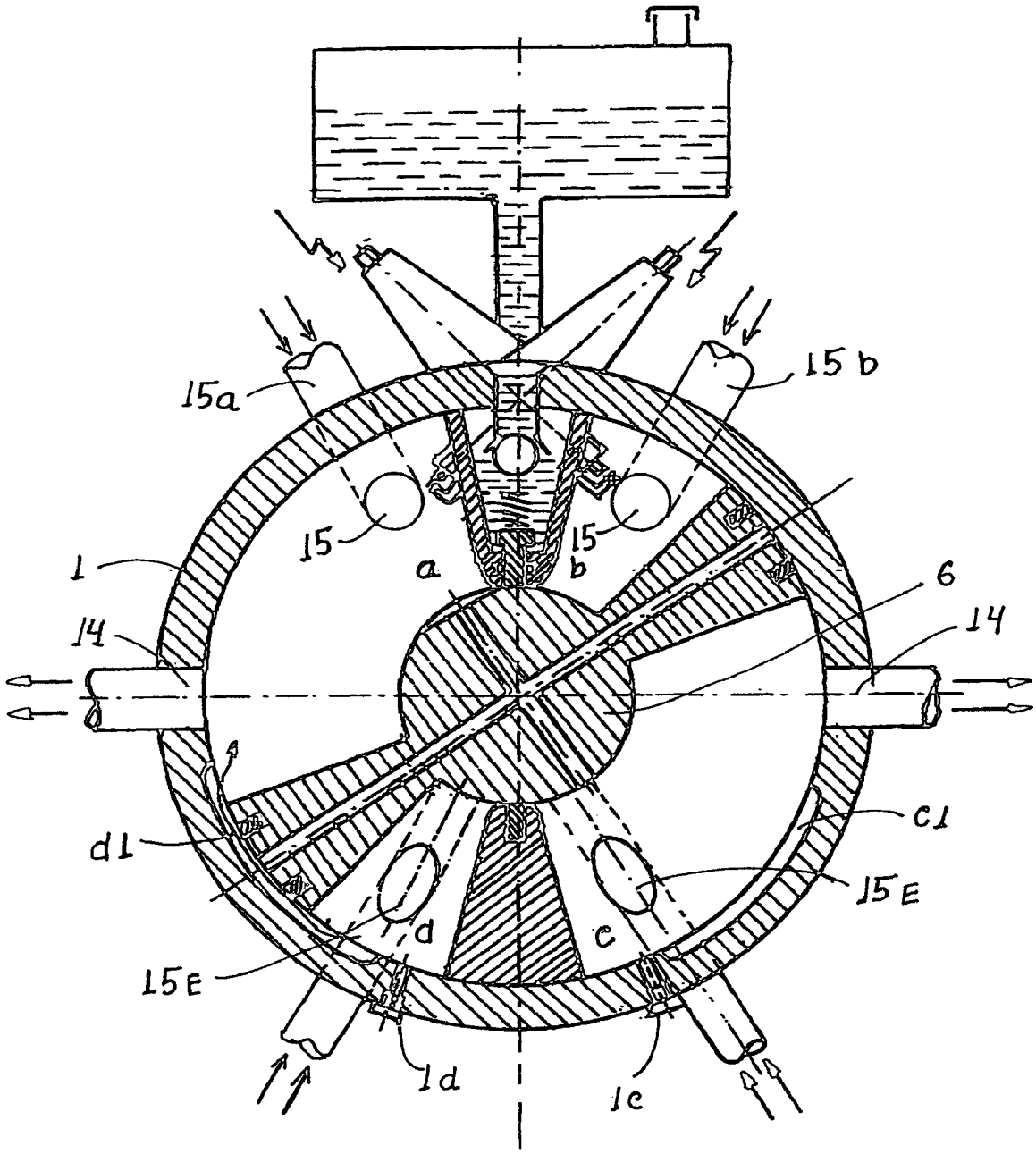
Figure 25:
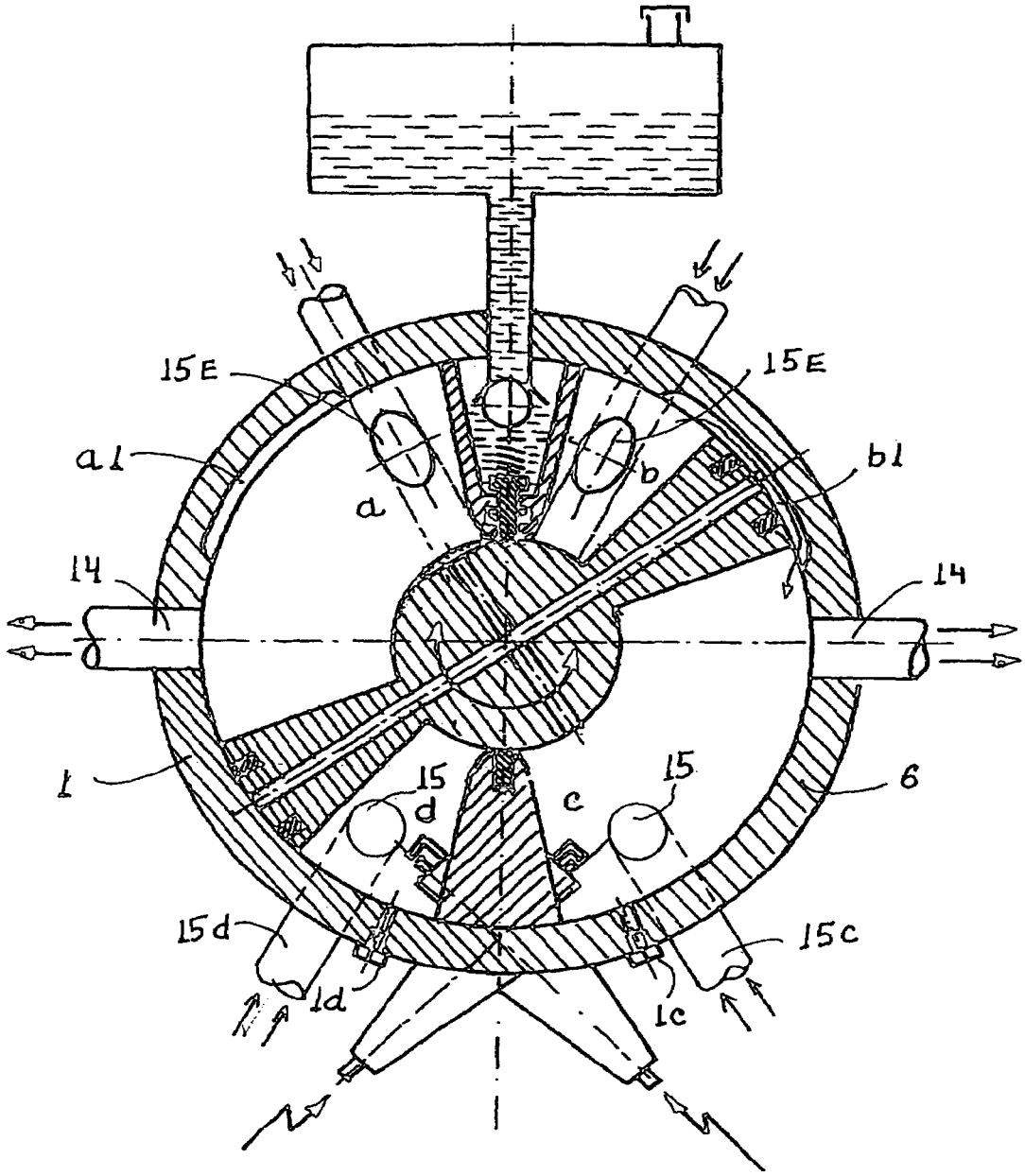
Figure 26:
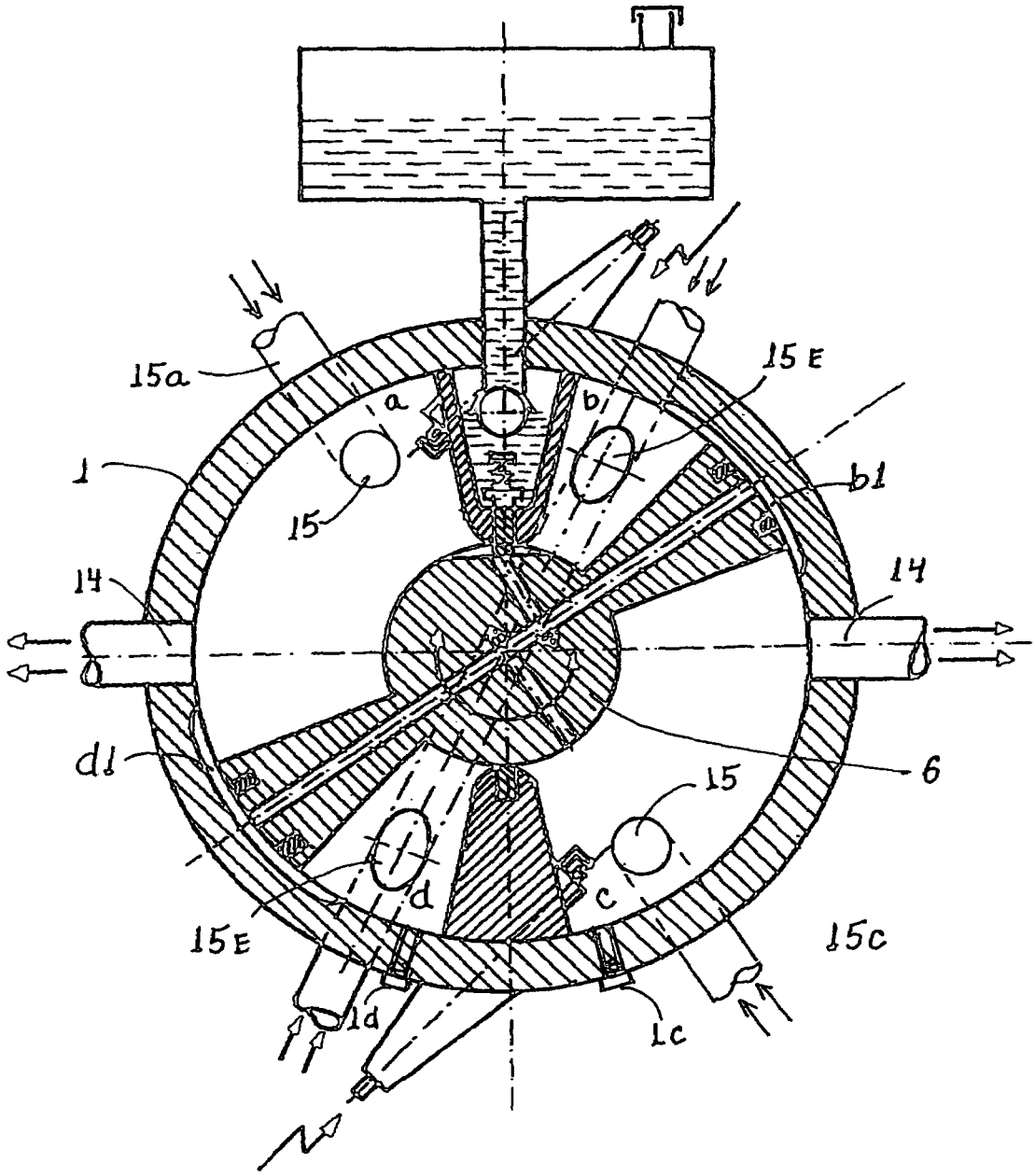
Figure 27:
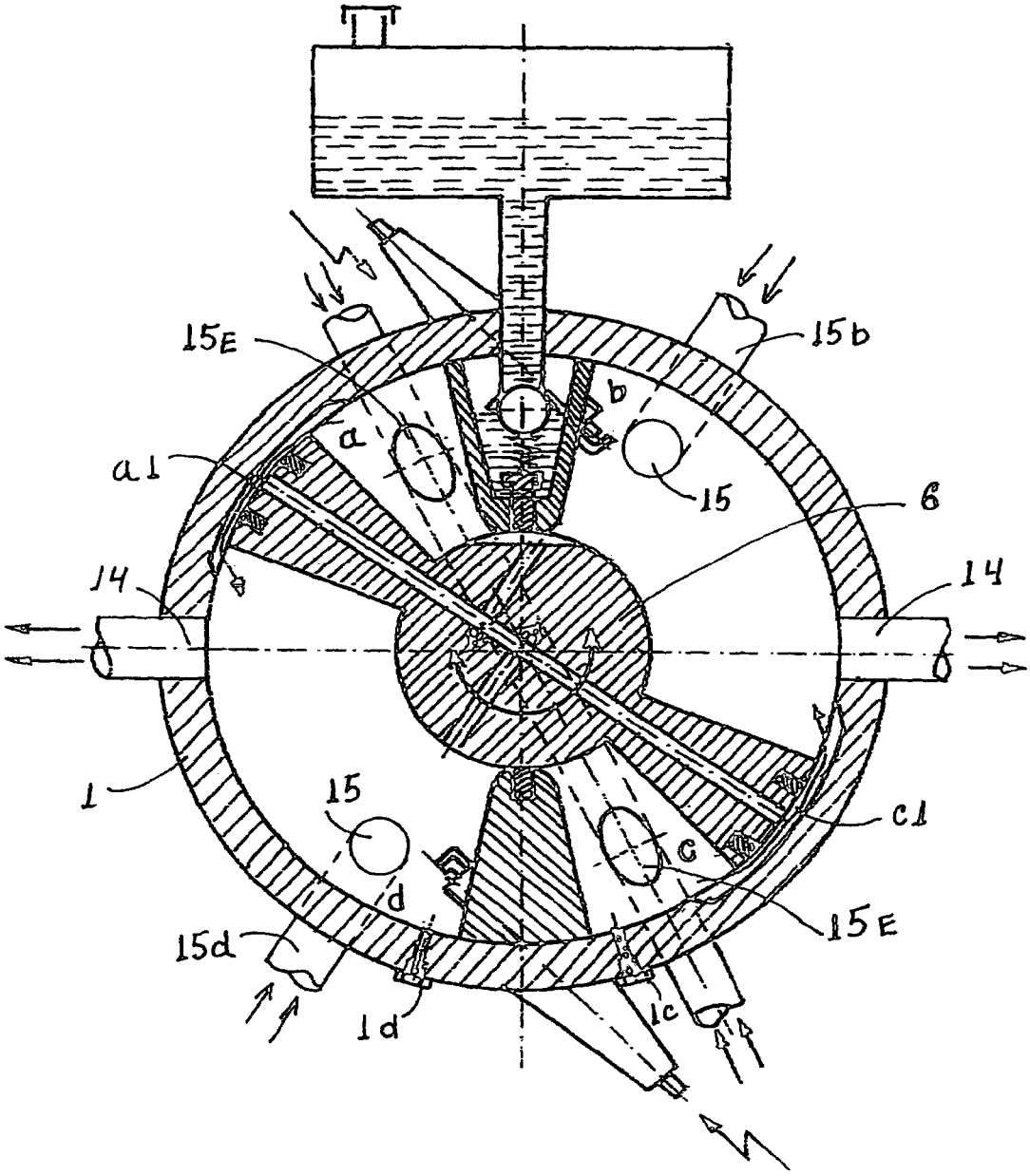
Figure 28:
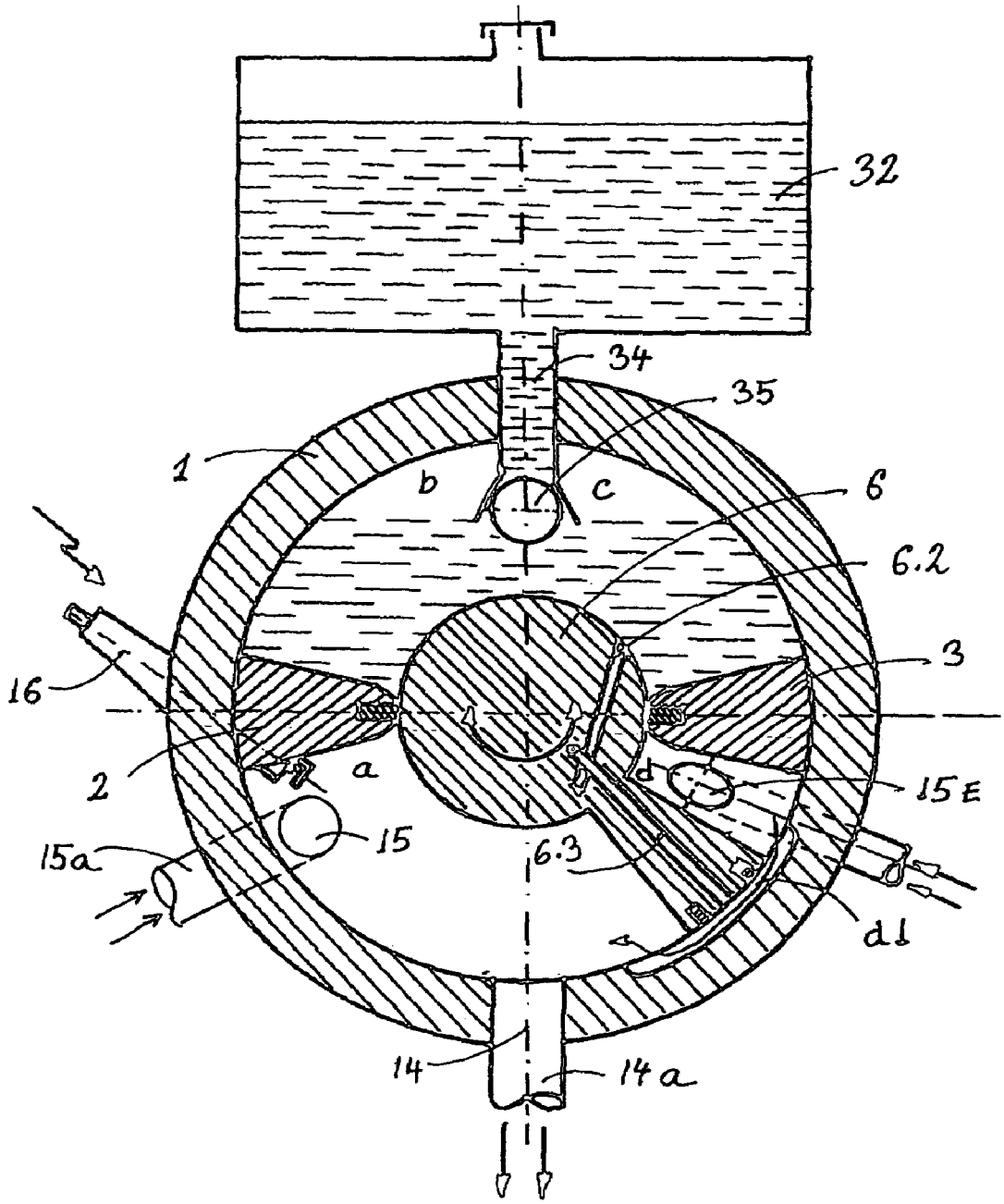
Figure 29:
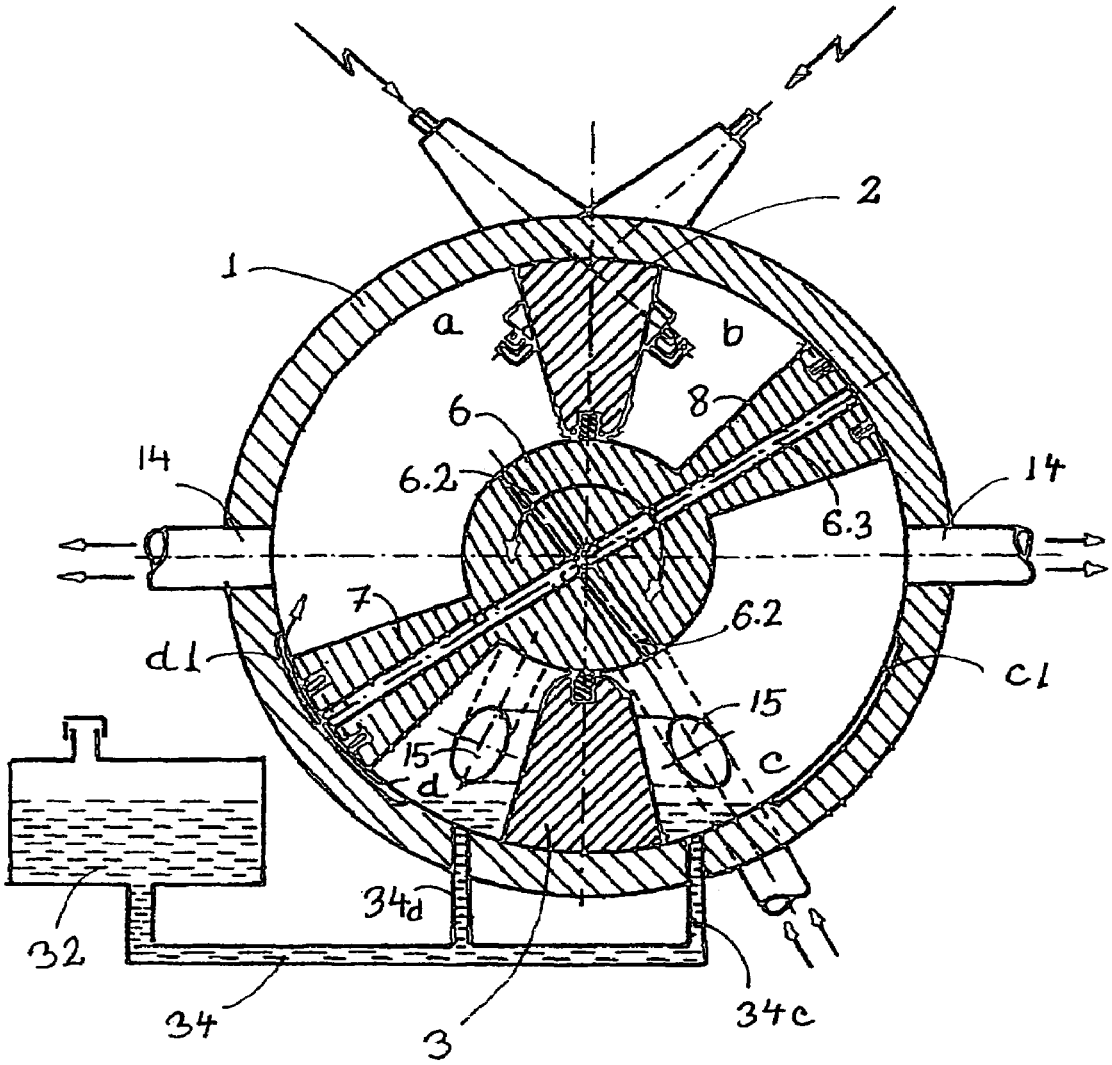

FIGS. 8 & 9 show the details of the self lubricating mechanism inside the top wall 2 of FIG. 7;

FIG. 10 is the same as FIG. 7 except that the two working chambers are b & d;

FIG. 11 is the same as FIG. 7 except that the two working chambers are c & d;

FIG. 12 is the same as FIG. 7 except that the two working chambers are a & b;

In FIG. 13 the vane 8 has been eliminated and there is only one working chamber (a), one spark plug, one intake port and one exhaust port. The engine has been turned counterclockwise 45% and chambers b & c become one chamber on the top, containing the lubricating oil;

In FIG. 14 there are four chambers in operation (a, b, c & d), four spark plugs, two exhaust ports shared by two working chambers (a & d) and (b & c) and four intake ports (15*a*, 15*b*, 15*c* & 15*d*) delivering fuel, air and lubricant directly into the working chambers;

FIG. 15 is the same as FIG. 14 except that only two chambers (a & b) remain operational;

FIG. 16 is the same as FIG. 14 except that only two chambers (c & d) remain operational;

FIG. 17 is the same as FIG. 14 except that only two chambers (a & c) remain operational;

FIG. 18 is the same as FIG. 14 except that only two chambers (b & d) remain operational;

FIG. 19 is a partial cross cut side view of the engine of FIG. 20. It shows external tubing connecting supporting chambers d & c to the working chambers a & b;

FIG. 20 is the same as FIG. 15 with two additional intake ports 15*e*, for air only and apertures 15*f* and 15*g* for the external tubing of FIG. 19, allowing compressed air to move from supporting chambers into the working chambers when the piston is in motion, acting as a supercharger;

FIG. 21 is the same as FIG. 16 with two additional intake ports 15*e*, for air only and apertures 15*f* and 15*g* for the external tubing of FIG. 19, allowing compressed air to move from supporting chambers into the working chambers when the piston is in motion, acting as a supercharger;

FIG. 22 is the same as FIG. 17 with two additional intake ports 15*e*, for air only and the apertures 15*f* and 15*g* for the external tubing of FIG. 19, allowing compressed air to move from supporting chambers into the working chambers when the piston is in motion, acting as a supercharger;

FIG. 23 is the same as FIG. 18 with two additional intake ports 15*e*, for air only and apertures 15*f* and 15*g* for the external tubing of FIG. 19, allowing compressed air to move from supporting chambers into the working chambers when the piston is in motion, acting as a supercharger;

FIG. 24 is the same as FIG. 12 with two additional intake ports 15*e*, for air only, located in the supporting chambers and two main intake ports 15, relocated in the working chambers delivering fuel only or fuel and air only directly into those chambers. Each cavity on the interior of the engine casing allows the additional air from ports 15*e* to move into the working chambers when the piston is in motion, turning the supporting chambers into superchargers;

FIG. 25 is the same as FIG. 11 with two additional intake ports 15*e*, for air only, located in the supporting chambers and two main intake ports 15, relocated in the working chambers delivering fuel only or fuel and air only directly into those chambers. Each cavity on the interior of the engine casing allows the additional air from ports 15*e* to move into the working chambers when the piston is in motion, turning the supporting chambers into superchargers;

FIG. 26 is the same as FIG. 7 with two additional intake ports 15*e*, for air only, located in the supporting chambers and two main intake ports 15, relocated in the working chambers delivering fuel only or fuel and air only directly into those chambers. Each cavity on the interior of the engine casing allows the additional air from ports 15*e* to move into the working chambers when the piston is in motion, turning the supporting chambers into superchargers;

FIG. 27 is the same as FIG. 10 with two additional intake ports 15*e*, for air only, located in the supporting chambers and two main intake ports 15, relocated in the working chambers delivering fuel only or fuel and air only directly into those chambers. Each cavity on the interior of the engine casing allows the additional air from ports 15*e* to move into the working chambers when the piston is in motion, turning the supporting chambers into superchargers;

FIG. 28 is the same as FIG. 13 with one additional intake port 15*e*, for air only, located in the supporting chamber, turning it into a supercharger, and one main intake port 15, relocated in the working chamber and delivering fuel only or fuel and air only directly into the working chamber;

FIG. 29 is similar to FIG. 12 except that the oil reservoir is on the bottom and it is attached via tubes to chambers c & d.

Figure 30:
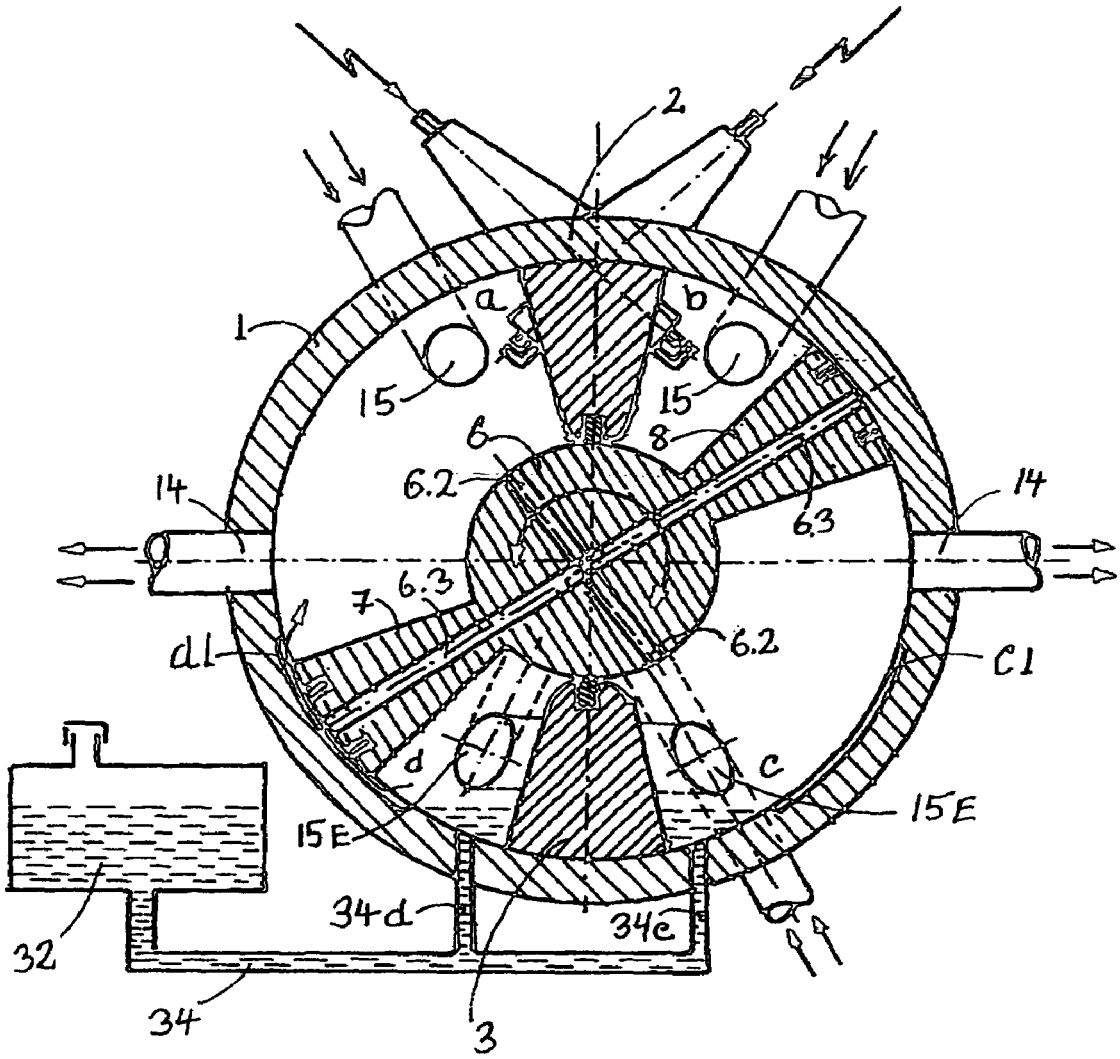

FIG. 30 is similar to FIG. 24 except that the oil reservoir is on the bottom and it is attached via tubes to chambers c & d.

Figure 31:
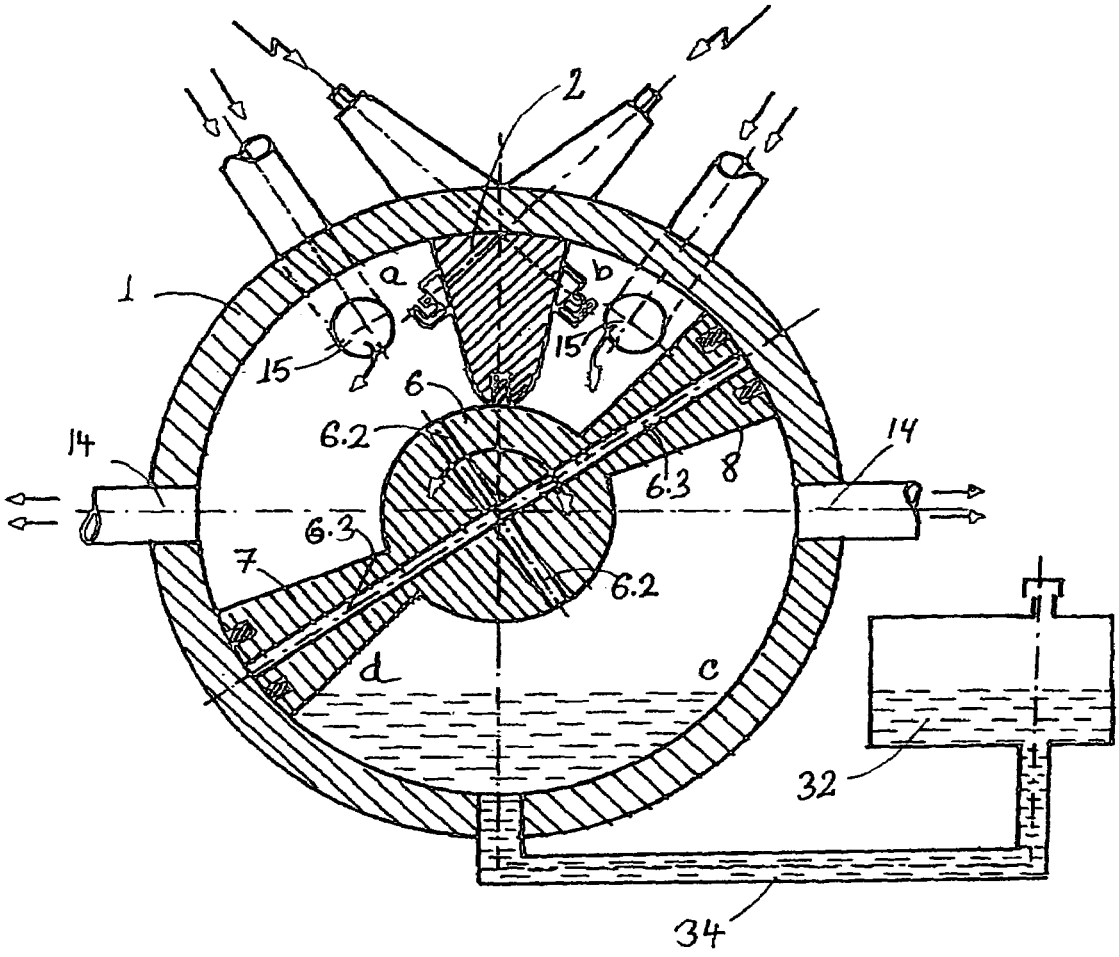

FIG. 31 is similar to FIG. 30 except that the bottom wall 3 is eliminated.

Figure 32:
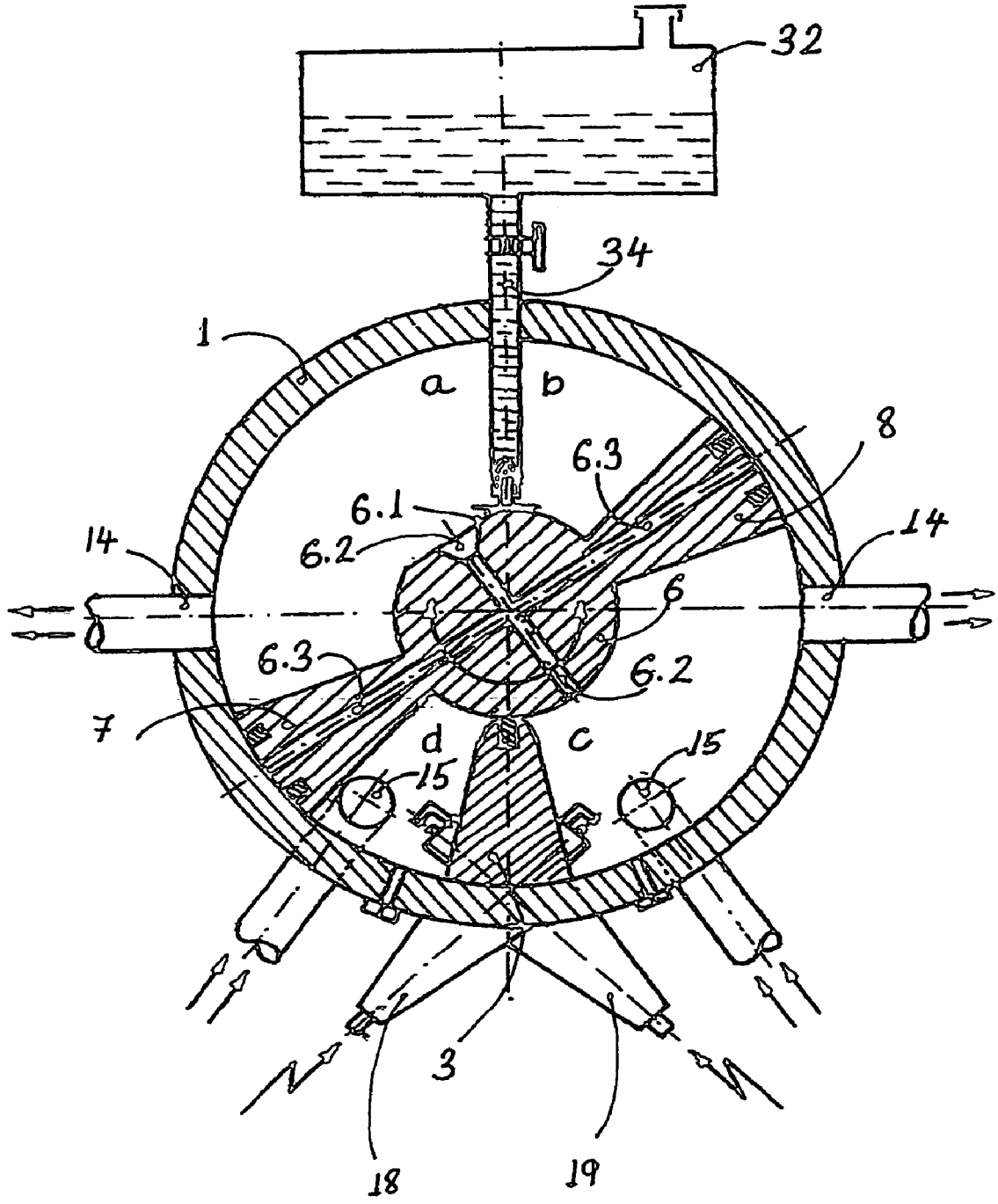
Figure 33:
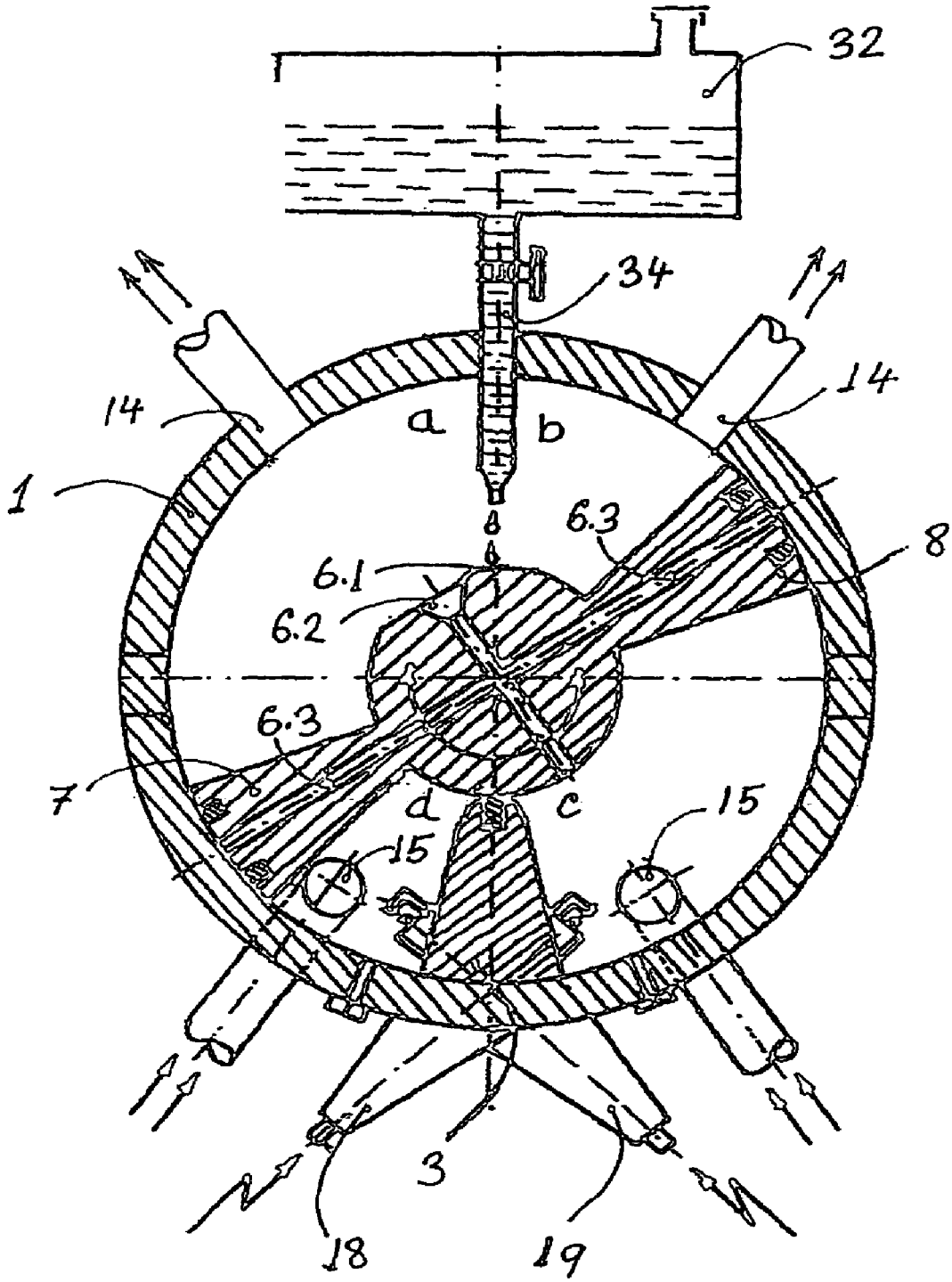

FIGS. 32 & 33 are similar to FIGS. 11 & 25 with the hollow top wall 2 eliminated and only two chambers (c & d) in operation.

FIG. 34 is similar to FIGS. 13 & 28 with two chambers (a & d) in operation.

Figure 35:
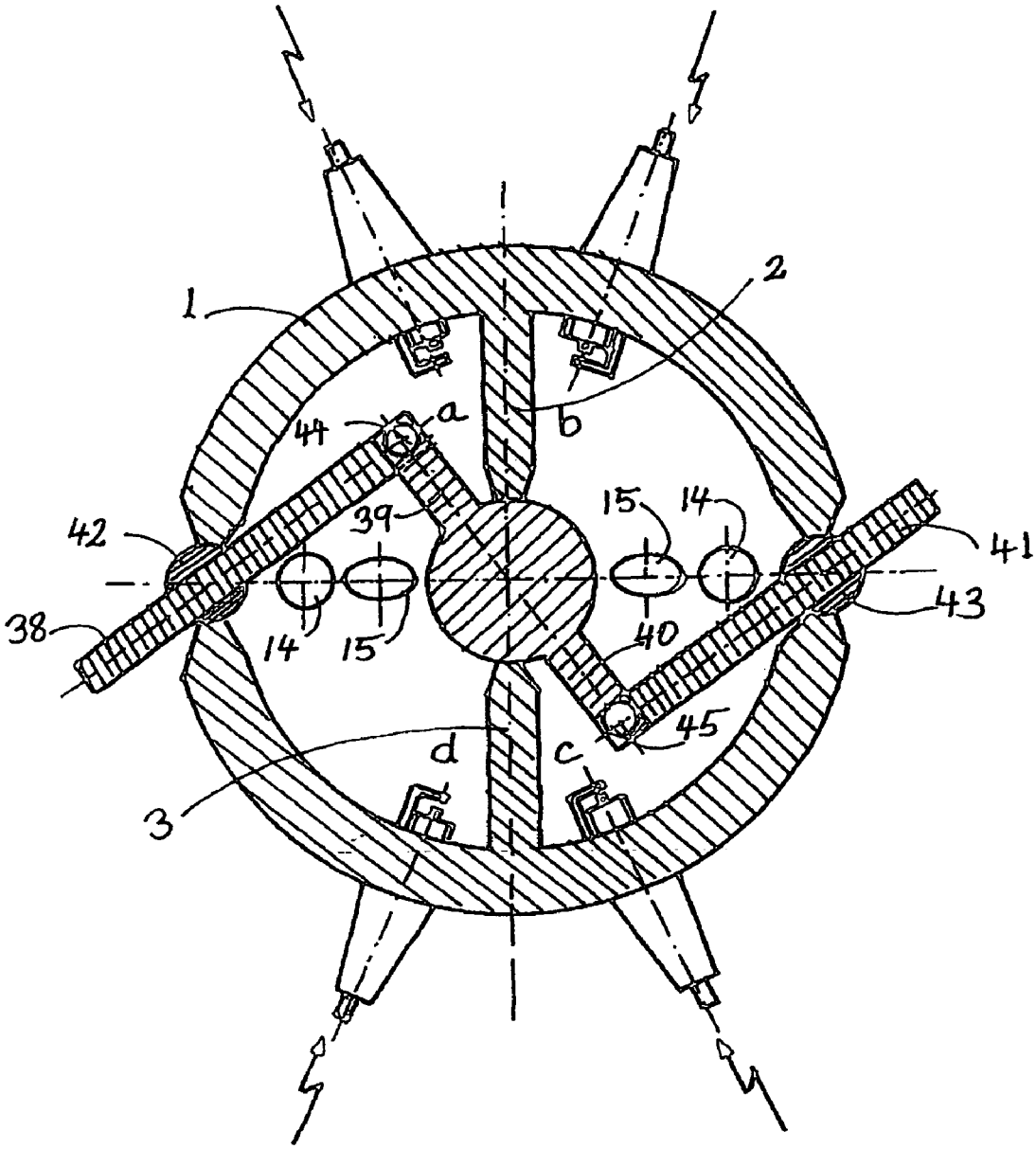

FIG. 35 shows schematically a cross section view of the engine with an alternative version of the operative vanes. The rigid longitudinal vanes 7 & 8 are replaced by articulating vanes 38, 39, 40 & 41.

Figure 36:
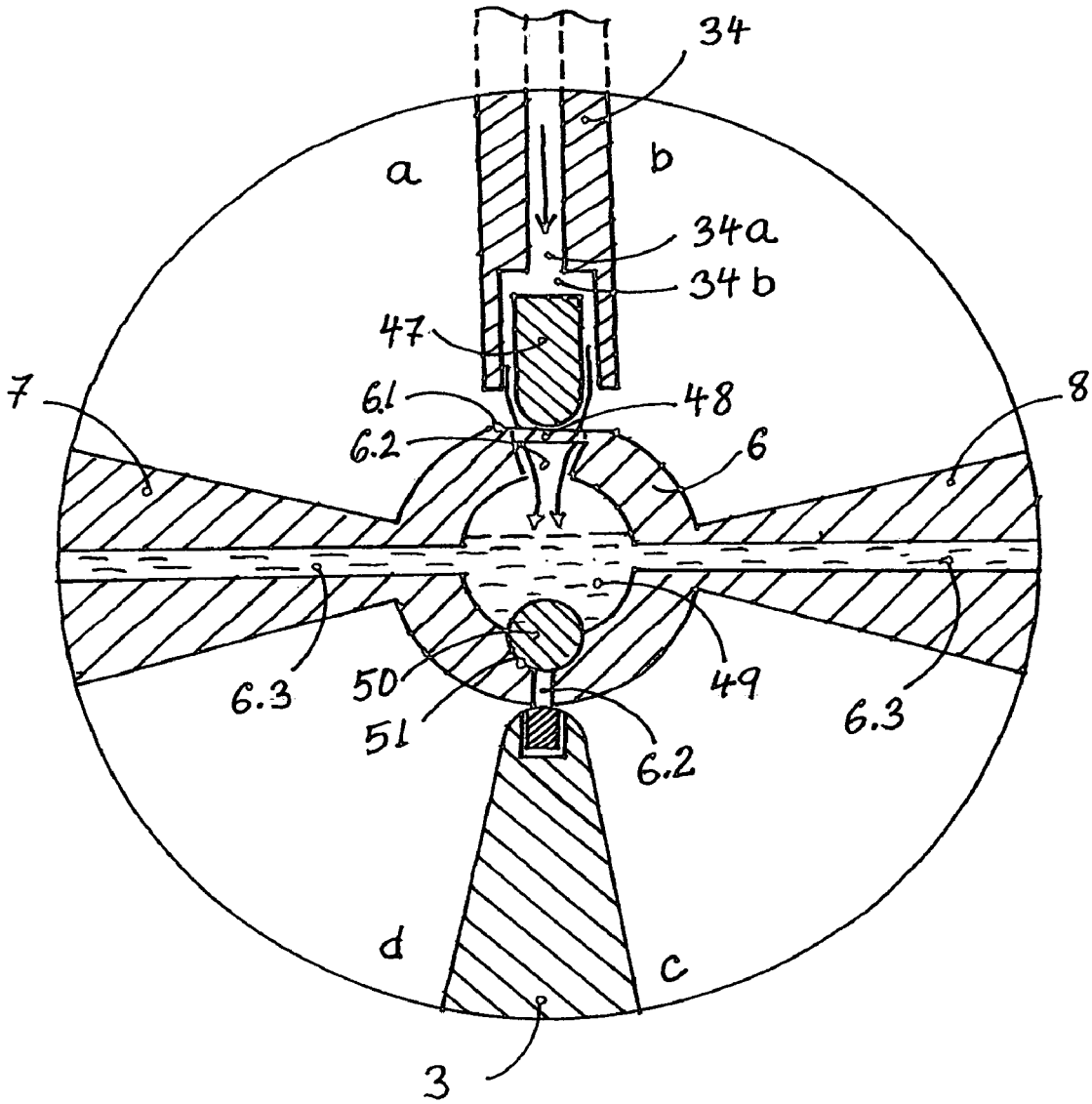

FIG. 36 is an enlarged view of a self lubricating mechanism with the tube 34 and partially hollow shaft 6.

Figure 37:
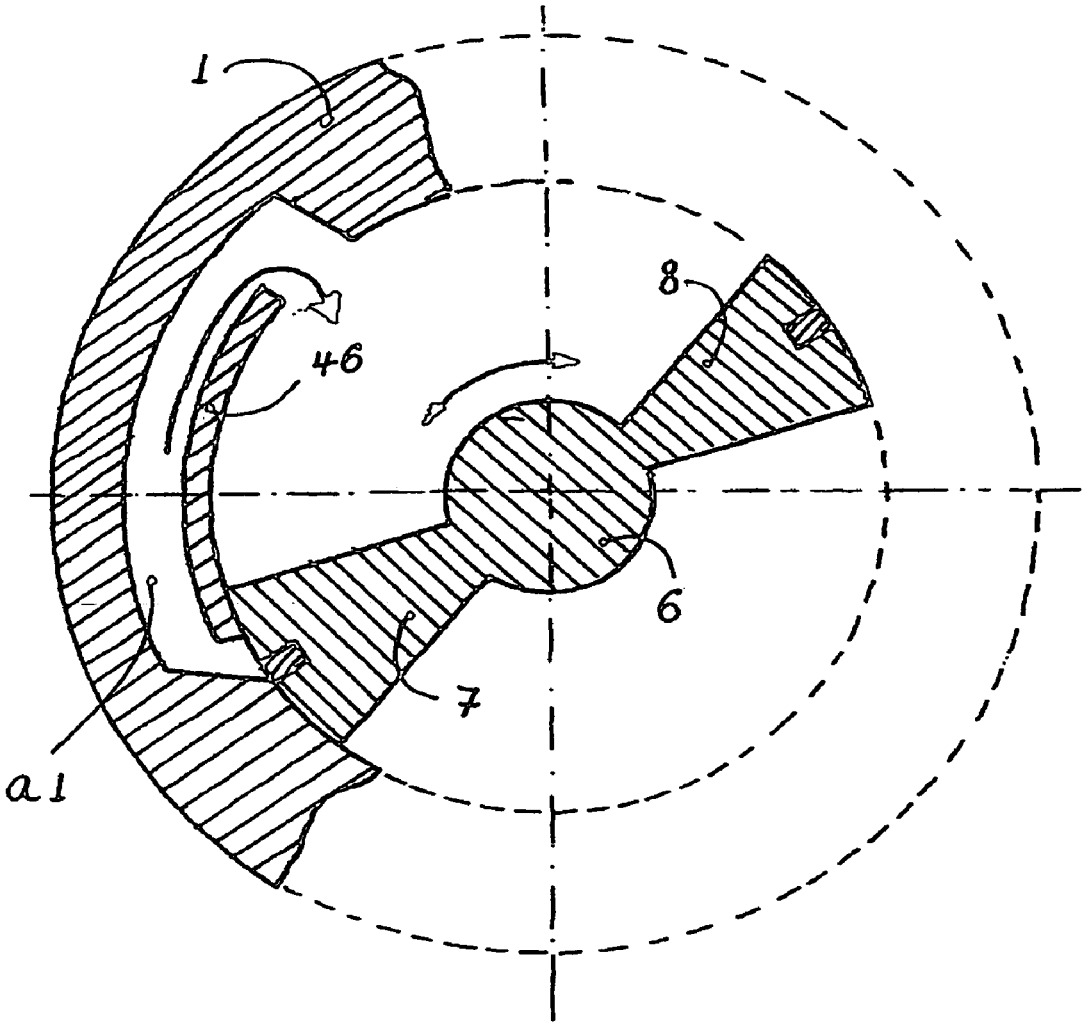

FIG. 37 shows schematically the interior cavities a1, b1, c1 or d1 of cylinder 1 which may be partially covered or bridged by the portion 46.

DETAILED DESCRIPTION

Figure 1:
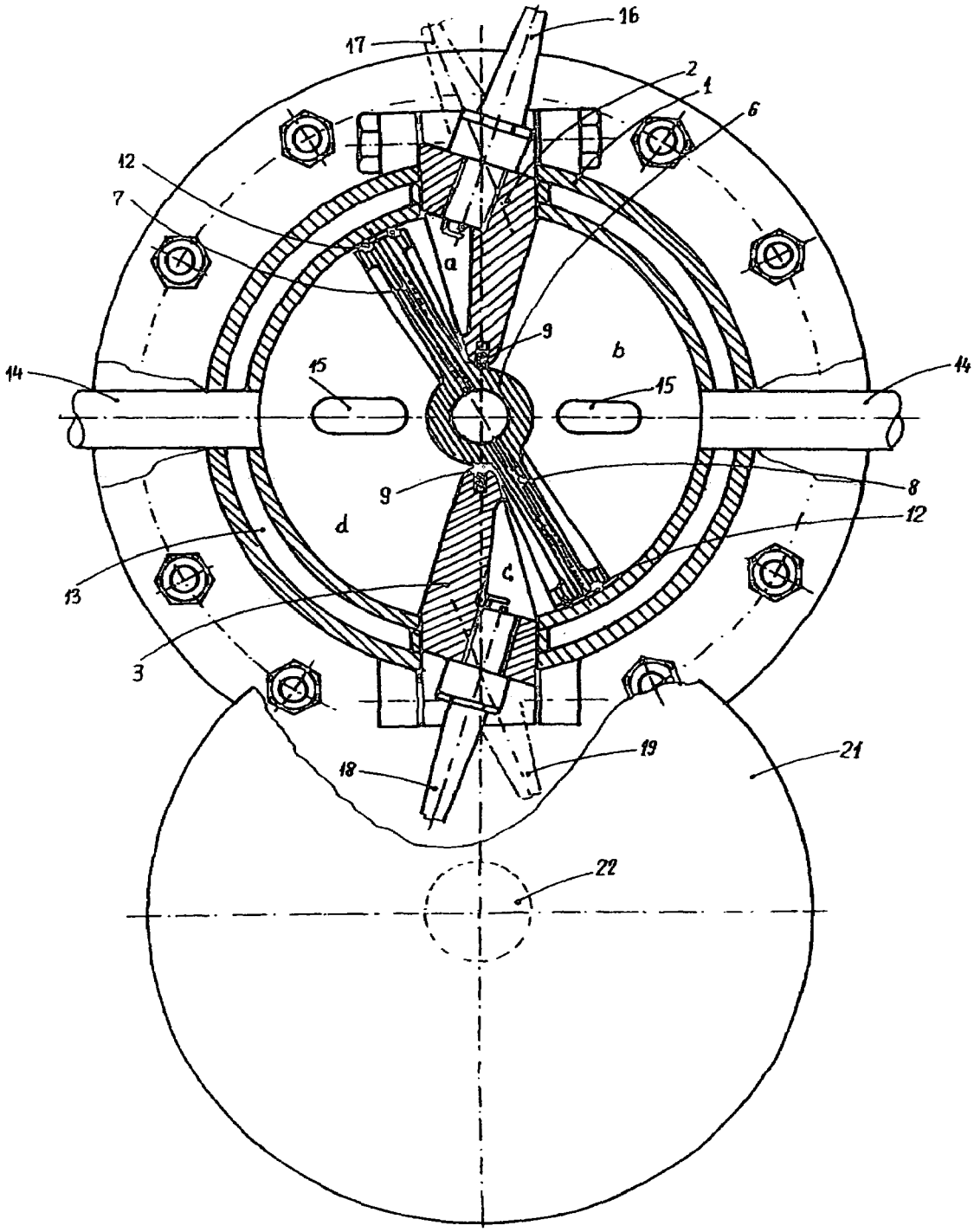
FIG. 1 is a cutaway sectional view across the instant rotating vane engine incorporating an essential swinging piston output shaft forming 4 chamber rooms inside a cylinder.

With reference to FIG. 1 in the drawings, the essential concept of the present invention and the means by which it is intended to operate may be appreciated. At 1, a double-walled, water-jacketed 13, longitudinally extending cylindrical casing is shown, in section. The casing may be conveniently made of aluminum, steel or other commonly used materials. The casing is equipped at 2 and 3 with longitudinally extending walls, which can be unitary with, or affixed to the casing 1. A rotary shaft 6 is suitably rotably mounted within the casing upon end plates 10 and 11. (FIG. 2) for the casing. The shaft is supported in the casing by commonly known bearing means 4 and 5 for mounting a rotary shaft in a motor, pump, or compressor. The shaft is partially hollow to allow the flow of cooling fluids inside it. Similar to the cylindrical casing the end plates 10 & 11 are also double-walled to allow coolant to flow freely from the water pump 25 through all the cavities of the cylinder, the end plates and the shaft in a closed circuit 26.

Fixedly attached to, or unitary with the shaft 6 are rotating vanes 7 and 8. Suitable seals 9 and 12 are provided between the walls 2 and 3 and the shaft 6 and between the vanes 7 and 8 and the casing 1 respectively.

The casing 1 is also equipped with plurality of ports, 14 and 15, which communicate between interior chambers a, b, c and d formed, as shown, between the vanes 7 and 8 and the casing walls 2 and 3. These ports allow the intake (15) of combustible fluids and lubricants and the exhaust (14) thereof from the aforementioned casing chambers. At 24 a compressor, a carburetor or an injection system delivers fuel mixture into the engine. At 23 a box is shown, containing the electrical and electronic systems of the engine. The intake ports 15 may be replaced by injection means.

Similarly, there are four ignition means, preferably comprising spark plugs, shown schematically at 16, 17, 18 and 19. The precise details of the ignition means, the valving means, the seals are not, in themselves subject of the present invention and various types of such known components could be used provided that the operative characteristics, in combination, are set forth. For example, Wankel type seals could be used.

Figure 2:
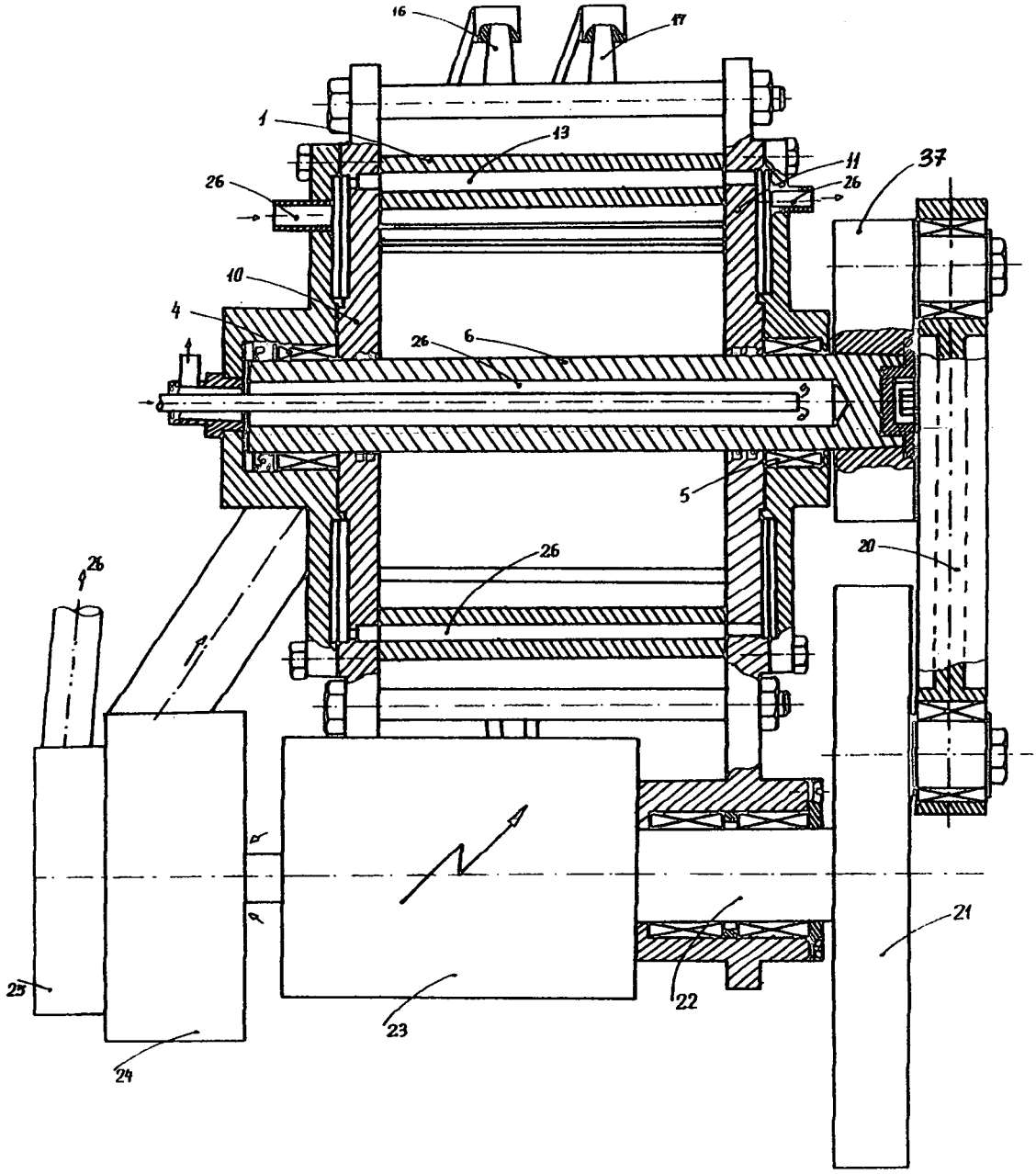
FIG. 2 shows schematically a cutaway cross section side view of the engine taken along the vertical line passing through the axis of the swinging piston shaft.

The particular mode of operation of the invention shown in FIGS. 1 and 2 now will be described. The vanes 7 and 8 can rotate clockwise and counterclockwise. In so moving the vanes continuously change the volume of the chambers a, b, c, and d.

In a two-stroke, four chamber operation the engine works as follows. In the position of the vanes shown in FIG. 1, vanes 7 & 8 are moving in counterclockwise direction and air-fuel mixture and lubricant are being drawn in through ports 15 to the expanding chambers a & c after the vanes move past these ports.

Simultaneous with the expansion of the chambers a & c are the contractions of the chambers b & d. The previously drawn combustible fluid mixture in chambers b & d is being compressed by the vanes 8 & 7 against the walls 2 & 3. At maximum compression in chambers b & d, ignition means 17 & 19 fire and cause vanes 8 & 7 to rotate now clockwise with concomitant expansion of these chambers. At the same time the burned exhaust gases in these chambers are free to leave through the ports 14, after the vanes open these ports by moving past them. The fuel mixture in chambers a & c is now being compressed and new fuel mixture and lubricant is being drawn in chambers b & d. The apertures of the exhaust ports (14) are always bigger in diameter or in size than the openings of the intake ports (15) in order for the exhaust to start exiting before the intake begins thus releasing pressure in the appropriate ignited working chambers.

At maximum compression, the igniters fire sequentially in couples, in the known manner.

Since the vanes 7 & 8 open and close intake and exhaust ports 15 & 14 for the appropriate chambers, just by moving past them, there is no need for additional internal or external valving.

The four chamber two-stroke operation of the engine may be replaced by a dual chamber operation where all of the processes described above are essentially the same for each chamber. For example, only the left or only the right side thus only two chambers in operation, a & d or b & c may be used, therefore only half of the engine, comprising half a cylinder, only one set of ports for intake and exhaust, two ignition means and only one vane, may be built.

FIGS. 5 & 6 show an embodiment of the engine with only two chambers (a & c) and only two spark plugs (16 & 18) in operation. The intake ports 15 are moved close to the walls 2 & 3 and could be located either on the heads of the engine as shown in FIGS. 5 & 6 or on the cylinder itself (not shown). The exhaust ports 14 remain on the same location as in FIG. 1. There are two cavities (b1 & d1) on the interior side of cylinder 1 as shown on FIGS. 5 & 6 or on the heads of the engine (not shown). Cavity b1 is for chamber b and cavity d1 is for chamber d. These cavities may be open as shown in FIGS. 5 & 6 or may be internal inside the walls of the casing with openings into the appropriate chambers. There is external tubing 15*ab*, 14*a* & 14*b* which connects the intake and exhaust ports to a membrane 29 and balls 30 or conical members 31 which automatically close and open these ports during the operation of the engine due to the pressure inside the appropriate chambers.

When vanes 7 & 8 move counterclockwise past the exhaust ports 14 (FIG. 5) they open those ports and allow the burning combustion fuel of chambers a & c to escape from those chambers through ports 14 and at the same time they push the previously drawn, through intake ports 15, combustible mixture of fluid, air and lubricant from chambers b & d into the chambers a & c through the cavities b1 & d1. At the same time the membrane 29 closes under pressure from the same mixture and prevents the mixture from escaping through the intake port 15.

In FIG. 6 vanes 7 & 8 move now in clockwise direction and the combustible mixture in chambers a & c is being compressed by these vanes against the walls 2 & 3. At the same time balls 30 close the exhaust ports 14 with the help of spring 30*a* and membrane 29 opens the intake port 15 under the low pressure in chambers b & d. A new mixture of fuel, air and lubricant is being sucked in and enters chambers b & d. At maximum compression in chambers a & c spark plugs 16 & 18 fire and cause vanes 7 & 8 to rotate again counterclockwise with concomitant expansion of these chambers. The whole operation repeats again in the same manner as described above for FIG. 5.

FIG. 7 shows an engine which is basically the same as the one described in FIGS. 5 & 6 except that the lubricating oil is not injected with the intake mixture of oil, fuel and air but it is provided in a separate container 32. The top wall 2 inside the engine is partially hollow which forms a cavity 33. That cavity is connected with a tube 34 through an opening in the cylinder to a reservoir or a container of engine oil 32 on the top of the casing. When the container is filled with oil, the oil drops from it through the tube into the cavity. At the lower end of that tube there is a hollow ball 35 which is floating on the surface of the oil inside the cavity of the wall. When the cavity 33 is partially full with oil, the ball closes the tube, thus preventing more oil entering that cavity.

At the lower end of wall 2 there is an opening 36 which allows the oil to leak inside the engine onto the shaft 6. FIGS. 8 & 9 are enlarged views of the bottom part of the hollow wall 2. They show the opening 36 which is narrowed on the top and on the bottom. The larger area 36.1 inside the opening serves as a small container for the oil before it enters the engine. It also serves as a dosing compartment supplying the engine with exact portions of necessary lubrication.

There is a segment 36.2 inserted in the opening 36 which has a profile of a pin or of a bolt as shown in the cross section of FIGS. 8 & 9. That segment closes the narrow top portion of the opening when it is down (FIG. 9). The segment also serves as sealing strip when it is up (FIG. 8). The bottom end of that pin segment is in constant contact with the shaft 6 and slides on the surface of that shaft all the time. The pin moves up and down depending on the position of the shaft. On the surface of the shaft 6 there is a flattened portion 6.1. When the shaft oscillates back and forth the pin segment 36.2 touches either the flat portion or the round portion of that shaft and moves up and down. When the pin segment touches the flat portion it slides down either under the pressure of its own weight, if in a vertical position, or under the pressure of the spring 36.3 on the top of the pin segment. In a down position it allows certain amount of oil to drip on the shaft from the dosing container 36.1 and at the same time it closes the narrow top opening of that container and prevents more oil from entering it. When the shaft turns and the round portion of it comes in contact with the pin segment, it pushes that segment up and stops the oil from leaking out of compartment 36.1 onto the shaft. At the same time it opens the top of that compartment and allows more oil to enter into it. When the shaft turns back and forth, the pin moves up and down, oil enters and leaves the container 36.1 and enables lubrication inside the engine with a precise predetermined amount of oil. The size of the pin segment regulates the amount of oil. The taller the pin, the more oil enters the small container and then the engine itself and vice versa.

As shown in FIG. 7 there are multiple channels and grooves 6.2 & 6.3 which run on the surface and inside the shaft 6 and the vanes 7 & 8. The channels and grooves 6.2 run approximately in the middle of the flat part of shaft 6. They run through that shaft and come out on the other side of the shaft. They are also connected with the channels and grooves 6.3 which are perpendicular to them and run through the shaft itself and the vanes 7 & 8. When oil drips on the flat portion of shaft 6, it enters the channels and grooves 6.2 and it moves towards the other side of the shaft. At the same time through the perpendicular channels and grooves 6.3 oil reaches each end of vanes 7 & 8 and both sides of the vanes facing the heads of the casing. In this way all of the surfaces inside the engine are being continuously lubricated during the operation.

In FIG. 7 there are two openings 1*c* & 1*d* on the bottom of the cylinder 1, one for chamber c and one for chamber d. These openings are normally closed with bolts but the bolts may be removed and the engine may be drained in case of oil overflow or general maintenance. This may be done when the engine is not in operation, if needed, or as a regular oil change procedure.

In operation the engine of FIG. 7 works as described for the engine of FIGS. 5 & 6 with intake and exhaust ports 15 & 14 connected to the membrane 29 and the balls 30 or conical attachments 31 (not shown on FIG. 7).

The engine of FIG. 10 is the same as the one of FIG. 7 except that the two working chambers now are chambers b & d and the two active spark plugs are 17 and 19.

In FIG. 11 a different embodiment of the same engine as the one of FIGS. 7 & 10 is shown. In this engine the two working chambers become the two neighboring lower chambers c & d. There are only two spark plugs 18 & 19 on the bottom of the cylinder 1. The two top neighboring chambers a & b now become only suppliers of new fuel mixture through the intake ports 15 and these two chambers now bear the cavities a1 & b1 on their internal enclosures. The operation of this embodiment of the engine differs from the engine of FIGS. 7 & 10 in the following way.

In the engine of FIGS. 7 & 10 the ignition means of the two working chambers fire simultaneously. In the engine of FIG. 11 the ignition means of the two working chambers c & d fire in sequence, one after the other. First when vane 8 moves clockwise, it compresses the combustible mixture in chamber c. At maximum compression, spark plug 18 fires and the expanding gases in chamber c move back vane 8, now in counterclockwise direction. On the other side vane 7 is moving also counterclockwise towards the wall 3 and it is compressing the combustible mixture in chamber d. When spark plug 19 fires at maximum compression, vane 7 is forced to move in the opposite direction and enables again the previously drawn combustible mixture on the other side in chambers c to be compressed by vane 8. Thus the whole process repeats again and the two spark plugs 18 & 19 fire in sequence one after the other.

In FIG. 12 a reverse embodiment of the engine of FIG. 11 is shown. The two working chambers now become the two top chambers a & b and the two active spark plugs are 16 & 17 on the top of the cylinder 1. Chambers c & d contain cavities c1 & d1 and also the intake ports 15. The engine works in the same manner as the one of FIG. 11 when the spark plugs 16 & 17 fire in sequence one after the other.

In FIG. 13 an engine is shown which contains only one working chamber, chamber a. The walls 2 & 3 are now positioned horizontally and only spark plug 16 remains functional. There is only one exhaust port 14 on the bottom of chamber a. The intake port 15 remains in chamber d and the cavity d1 is shared by chambers a & d. The exhaust and intake ports 14 & 15 are connected to a ball 30 and a membrane 29 respectively, as shown on FIGS. 5 & 6. On the top, vane 8 is eliminated and chambers b and c of previous engines form only one chamber now which serves as oil container. That oil container is connected through an opening and a tube 34 to a reservoir of oil 32 above the engine. There is a hollow ball 35 floating on the surface of the oil inside the oil container of chamber bc which closes the bottom of tube 34 and prevents more oil entering that chamber when there is sufficient oil in it. There are channels and grooves 6.2 & 6.3 on the shaft 6 and vane 7 which allow a flow of oil to move through them and to reach the inside walls of chambers a and d for purpose of lubrication similarly to the engines of FIGS. 7, 10, 11 & 12.

In operation of this embodiment of the engine, when vane 7 moves counterclockwise, it pushes the previously drawn combustible mixture of fuel and air from chamber d into chamber a through the cavity d1 on the inside of the cylinder 1 or on the heads of the engine (not shown). Since vane 7 is connected through the shaft 6 to the crank 37 (FIGS. 2 & 3), at a certain point it reverses directions. It starts moving clockwise, closes the exhaust port 14 and compresses the combustible mixture in chamber a. At the same time it sucks new combustible mixture from intake port 15 into chamber d. At maximum compression spark plug 17 fires and causes vane 7 to move in the opposite direction again. When vane 7 moves past the exhaust port 14 it releases the burned gases from chamber a through that port and pushes a new mixture from chamber d into chamber a through the cavity d1. The operation repeats again in the same manner as described above.

On FIG. 14 an engine is shown which is the same as the one of FIG. 1 except that there are four intake ports 15*a*, 15*b*, 15*c* & 15*d*, delivering fuel, air and lubricant directly into the working chambers a, b, c & d. These intake ports are connected to opening and closing membranes. There are couple of exhaust ports 14 connected to opening and closing balls or conical members (FIGS. 5 & 6). There are four ignition means which fire sequentially in couples at the end of each compression stroke.

In FIG. 15 an engine is shown which is the same as the one of FIG. 14 except that there are only two working chambers (a & b) and only two intake ports (15). These intake ports are connected via tubes 15*a* & 15*b* to membranes (FIGS. 5 & 6). There are two exhaust ports located close to the wall 3 for a longer working stroke and connected via tubes to balls or conical members (FIGS. 5 & 6). There are two spark plugs in operation, one for each working chamber, firing sequentially at the end of each compression stroke.

In FIG. 16 the engine is the same as the one of FIG. 15 except that the two working chambers are c & d.

In FIG. 17 the engine is the same as the one of FIG. 15 &16 except that the two working chambers are a & c. The two active spark plugs in operation (16 & 18) fire now simultaneously at the end of each cycle.

In FIG. 18 the engine is the same as the one of FIGS. 15 &16 except that the two working chambers are b & d. The two active spark plugs in operation (17 & 19) fire now simultaneously at the end of each cycle.

In FIGS. 20, 21, 22 & 23 the basic design of the engine is the same as the design of FIGS. 15, 16, 17 & 18 except that there is a couple of intake ports 15*e* for additional air only delivered into the supporting chambers. These intake ports are also connected to opening and closing membranes as the main intake ports 15 (FIGS. 5 & 6). There are two more couples of apertures (15*f* & 15*g*) connected via external tubing (FIG. 19), allowing the additional air to move one way from supporting chambers into the working chambers enabling the supporting chambers to act as superchargers.

FIGS. 24, 25, 26 & 27 are identical with FIGS. 12, 11, 7 & 10. The two supporting intake ports 15*e*, for additional air only, located in assisting chambers are connected via tubes to opening and closing membranes (FIGS. 5 & 6). Air moves from them into the working chambers through open or closed cavities on the interior of the casing, when the swinging piston is in motion, turning them into superchargers. The two main intake ports are located inside the working chambers and deliver fuel only or fuel and air only directly into them. The intake ports 15 are connected via tubes to opening and closing membranes. The intake ports 15 may be replaced by fuel injection means. The exhaust ports 14 remain approximately in the middle on both sides of the casing and it is connected via tubes to opening and closing balls or conical members. The lubricating oil is delivered through the cavity inside the top wall 2.

FIG. 28 is the same as FIG. 13 with one supporting intake port 15*e*, for additional air only, located in the supporting chamber, turning it into a supercharger, and one main intake port 15, relocated in the working chamber and delivering fuel only or fuel and air only directly into the working chamber. The intake port 15 may be replaced by a fuel injector.

The engine of FIG. 29 is the same as the one of FIG. 12 except that the lubrication mechanism is located on the bottom of the engine. There is a reservoir of oil 32 attached via tubes 34 and 34*c*, 34*d* to supporting chambers c & d. Oil moves from the reservoir 32 into these chambers and when the vanes 7 & 8 oscillate they enter the oil that collects on the bottom of the chambers thus lubricating the interior of the engine.

In FIG. 30 the lubrication mechanism of the engine is the same as the one of FIG. 29 but in operation the engine works as the engine of FIG. 24.

In FIG. 31 the lubrication of the engine is similar to the lubrication mechanism of FIGS. 29 & 30 with the oil container 32 on the bottom and only one tube (34) connecting it to chambers c & d. The bottom wall 3 of the engine is eliminated and chambers c & d form now one lubricating chamber cd. When the vane 7 & 8 oscillate they enter the oil in that chamber and carry it through the interior of the engine thus lubricating it.

In FIGS. 32 & 33 the top hollow wall 2 of FIGS. 11 & 25 and the lubricating mechanism inside it is eliminated. Lubricating oil drips directly from the reservoir 32 through the tube 34 into chambers ab. There are only two chambers (c & d) remaining in operation.

In FIG. 34 there are two chambers (a & d) in operation.

In the alternative embodiment of FIG. 35, the rigid longitudinal vanes 7 and 8 are replaced by articulating vanes 38, 39, 40 and 41. In operation, with respect to the vane segments 39 and 40, the operation is as previously described with respect to FIG. 1. However, because of the articulated vane sections 38 an 41, the shaping of the chambers a, b, c and d is different from that shown in FIG. 1. The articulated vane segments 38 and 41 are suitably mounted for slidable rotation within slide-bearing means 42 and 43. The bearings are rotatable within the casing while allowing vane segments 38 and 41 to slide therethrough.

As shown in FIG. 35, chambers are formed between the walls 2 and 3 and the vanes 38–39 and 4041. As the vane segments 39 and 40 rotate clockwise, the vane segments 38 and 41 respectively nutate about the joints 44 and 45 while simultaneously sliding within the bearings 42 and 43. The chambers a, b, c and d, therefore, expand and contract in a balanced fashion similar to the straight chambers shown in the embodiment of FIG. 1.

On FIG. 36 an enlarged view of an alternative lubricating mechanism is shown. The top wall 2 has been eliminated and the tube 34 connects the oil container 32 (not shown) to the shaft 6. The tube is narrow on the top (34*a*) with a larger diameter (34*b*) on the bottom where a segment with a bullet like profile is inserted. That segment is in constant contact with the shaft 6. When it comes in contact with the flat portion 6.1 of the shaft, it drops down and opens tube 34 allowing oil to flow from the tube into the hollow portion 49 of shaft 6 and then into the grooves and channels 6.2 and 6.3 thus lubricating the inside of the engine. The top part of channels 6.2 has a funnel like profile enabling oil to enter easily the hollow portion 49 of shaft 6. There is a cylinder 50 inside that hollow portion which moves freely when the swinging piston is motion but when the piston stops with vane 7 & 8 in horizontal position as on FIG. 36, it enters the bedding 51 and closes the lower part of channels 6.2 preventing oil from leaking into chambers c & d.

The cross cut sectional view of FIG. 37 shows schematically an alternative modification of the interior cavities a1, b1, c1 or d1. Here as an example the cavity a1 may be partially hidden or covered inside the wall of cylinder 1 by the portion 46 with two internal openings for the appropriate chambers.

Thus the preferred embodiments of the invention have been illustrated and described. It must be clearly understood that the preferred embodiments are capable of variation and modification and are not limited to the precise details set forth. For instance, it is apparent that the parts may be modified in size and materials without affecting the essence of the invention. This invention includes all variations and modifications, which fall within the scope of appended claims.

What is claimed is:

1. A rotatably two-stroke reciprocating valveless vane internal combustion engine comprising:

a cylindrical casing (1), said cylindrical casing including:

a double wall wherein cooling fluid is passing through;

longitudinally extending walls (2, 3) being unitary or affixed to said cylindrical casing (1);

end plates or heads (10 & 11);

a power output rotary hollow shaft (6) mounted within said cylindrical casing upon said end plates (10 & 11) and vanes (7 & 8);

four working chambers (a, b, c & d) formed between said vanes (7 & 8) and said longitudinally extending walls (2 & 3) inside said cylindrical casing;

wherein said vanes (7 & 8) are unitary or affixed to said power output rotary hollow shaft (6), and thereby alternatively rotate in back and forth fashion in such manner that the volume of said four working chambers between said vanes and the walls compresses and expands in such sequence that a two-stroke mode of the internal combustion engine operates;

wherein each of said four working chambers is simultaneously operated in a stroke of intake-and-compression, and then in a reversed stroke of expulsion-and-exhaust;

intake ports (15*ab* and 15*cd*), wherein each of said intake ports is located on said end plates or heads (10 or 11) or on said cylindrical casing (1) close to said longitudinally extending walls (2 & 3) and connected via an intake tube to a membrane (29), which opens and closes said intake tube;

exhaust ports (14), wherein each of said exhaust ports is connected via an exhaust tube to a ball (30) or a conical member (31), which opens and closes said exhaust tube; and spark plug(s), igniting the compressed fuel mixture at maximum compression, and firing sequentially into said working chambers at the end of a cycle.

2. The rotatably two-stroke reciprocating valveless vane internal combustion engine according to claim 1, further comprising:

a cavity (33) inside the top of said longitudinally extending wall (2) connected via an oil tube (34) to a container of oil (32) on the top of cylindrical casing (1);

a ball (35) floating on the surface of the oil inside said cavity (33) and closing said oil tube 34 when the amount of oil in said cavity is sufficient;

an opening (36) at the lower end of said longitudinally extending wall (2) allowing oil to leak from said cavity (33) on the flat portion (6.1) of said power output rotary hollow shaft (6);

wherein said opening is narrow at the top and at the bottom, forming a dosing compartment (36.1) in the middle and supplying the inside of the engine with exact portions of necessary lubrication;

a segment (36.2) having a pin or a bolt profile closing the top of said compartment (36.1) in a down position and opening the bottom, allowing oil to leak from said compartment (36.1) onto said flat portion (6.1) of said power output rotary hollow shaft (6) when said shaft (6) rotates;

a spring (36.3) facilitating the downward motion of said segment (36.2), allowing said segment (36.2) to close the dosing compartment (36.1) and to serve as a sealing strip between said longitudinally extending wall (2) and said power output rotary hollow shaft (6); and multiple channels and grooves (6.2 and 6.3) running on the surface and inside said power output rotary hollow shaft (6) and vanes (7 & 8), and delivering lubricating oil from said dosing compartment (36.1) to internal surfaces of the engine.

3. A rotatably two-stroke reciprocating valveless vane internal combustion engine comprising:

a cylindrical casing (1), said cylindrical casing including:

a double wall wherein cooling fluid is passing through;

longitudinally extending walls (2, 3) being unitary and affixed to said cylindrical casing (1);

end plates (10 & 11);

a power output rotary hollow shaft (6) mounted within said cylindrical casing upon said end plates (10 & 11);

vanes (7 & 8);

sealing strips (9 & 12) embodied in grooves and provided between said longitudinally extending walls (2 & 3) and the power output rotary hollow shaft (6), and between said vanes (7 & 8), said cylindrical casing (1) and said end plates (10 & 11) respectively;

four working chambers (a, b, c & d) formed between the vanes (7 & 8) and the longitudinally extending walls (2 & 3) inside said cylindrical casing;

wherein said vanes (7 & 8) are unitary or affixed to said power output rotary hollow shaft (6), and thereby alternatively rotate in back and forth fashion with respect to said longitudinally extending walls in such manner that the volume of said four working chambers between said vanes compresses and expands in such sequence that a two-stroke mode of internal combustion engine operates;

wherein each of said four working chambers is simultaneously operated in a stroke of intake-and-compression, and then in a reversed stroke of expulsion-and-exhaust;

two sets, one of intake and one of exhaust ports (15 & 14);

wherein each set of said intake and exhaust ports (15, 14) includes intake ports (15) for simultaneously delivering combustible air-fuel mixture and lubricating oil into said working chambers, and exhaust ports (14) for discharging exhaust gas;

wherein each of said intake and exhaust ports is shared by two of said four working chambers;

wherein said intake and exhaust ports (15 & 14) are centrally and horizontally aligned to each other in the cylindrical casing (1), and wherein said exhaust ports (14) are sufficiently bigger in size compared to intake ports (15) to allow release of pressure before the intake stroke begins; and four ignition means (16, 17, 18 & 19) igniting the compressed fuel at maximum compression, and firing sequentially and simultaneously in each of said four working chambers at the end of each cycle.

4. The rotatably two-stroke reciprocating valveless vane internal combustion engine according to claim 3, wherein injection means are incorporated within each of said four working chambers and wherein said intake ports (15) supply the interior of the working chambers with sufficient airflow for the burning fuel and with a lubricating oil.

5. The rotatably two-stroke reciprocating valveless vane internal combustion engine according to claim 3, further comprises means for imparting continuous rotation from said power output rotary hollow shaft (6) to a uni-directionally rotating main shaft (22) comprising:

a crank (37) secured to said power output rotary hollow shaft;

a connecting rod (20) swivably mounted to said crank and said uni-directionally rotating main shaft (22) through a slot on a flywheel (21);

wherein said connecting rod pivots back and forth across the vertical line passing through the axis of the power output shaft (6) and the axis of said uni-directionally rotating main shaft (22), and wherein said connecting rod is extendable and adjustable in length at point (27);

wherein the lower part of said connecting rod is rotatably and movably attached to a slot formed on said flywheel (21) and is fixed together with a fastening member via that slot to said flywheel in a predetermined position thus adjusting the length of the stroke of the alternating vanes for optimum performance; and wherein said fastening member comprised of a bolt and a nut coupled to the lower portion of the rod and to the slot on the flywheel.

6. A rotatably two-stroke reciprocating valveless vane internal combustion engine comprising:

a cylindrical casing (1), said cylindrical casing including:

a double wall wherein cooling fluid is passing through;

longitudinally extending walls (2, 3) being unitary or affixed to said cylindrical casing (1);

end plates (10 & 11);

a power output rotary hollow shaft (6); mounted within said cylindrical casing upon said end plates (10 & 11);

vanes (7 & 8);

wherein said vanes (7 & 8) are unitary or affixed to said power output rotary hollow shaft (6), and thereby alternatively rotate in back and forth fashion;

four working chambers (a, b, c & d) formed between the vanes (7 & 8) and the longitudinally extending walls (2 & 3) inside said cylindrical casing;

wherein at least one of said four working chambers is being operated as an assisting chamber for delivering and supercharging fuel-air and lubricant mixture;

wherein at least one of said four working chambers is being operated as a power output chamber for igniting and firing said fuel and air mixture;

wherein at least one of said working chambers and said assisting chambers formed between the vane(s) (7 or 8 or 7 & 8) and the longitudinally extending walls (2 & 3) inside the casing change their volume in accordance with the position of the vane(s);

four cavities (a1, b1, c1, d1) located on an interior side of said four working chambers;

wherein each of said cavities is shared by one of said working chambers and one of said assisting chambers;

wherein each of said cavities is located on the interior of the cylindrical casing (1) or on said end plates (10 & 11) to allow the combustible air-fuel and lubricant mixture to move from the assisting chamber into the working chamber when the alternating vanes are in motion;

wherein at least one intake port (15) in at least one of said assisting chambers, is positioned on said end plates (10 & 11) or on the cylindrical casing (1) close to the longitudinally extending walls (2 or 3 or 2 & 3) and is connected via an intake tube to membrane (29), which opens and closes said intake tube;

at least one exhaust port (14), connected via an exhaust tube to a ball (30) or to a conical member (31), which opens and closes said exhaust tube; and ignition means for igniting and firing the compressed air-fuel mixture in said working chambers at the maximum compression at the end of a cycle.

7. The rotatably two-stroke reciprocating valveless vane internal combustion engine according to claim 6, further comprising:

a cavity (33) inside the top part of said longitudinally extending wall (2) connected via an oil tube (34) to a container of oil (32) on the top of the cylindrical casing (1);

a ball (35) floating on the surface of the oil inside said cavity (33) closing said oil tube (34) when an amount of oil in said cavity is sufficient;

an opening (36) at the lower end of said longitudinally extending wall (2) allowing oil to leak from said cavity (33) on the flat portion (6.1) of said power output rotary hollow shaft (6);

wherein said opening is narrow at the top and at the bottom, forming a dosing compartment (36.1) in the middle, and supplying the inside of the engine with exact portions of necessary lubrication;

a segment (36.2) having a pin or a bolt profile, closing the top of said compartment (36.1) in a down position and opening the bottom, allowing oil to leak from said compartment (36.1) onto said flat portion (6.1) of said power output rotary hollow shaft (6) when said shaft (6) rotates;

a spring (36.3) facilitating the downward motion of said segment (36.2), allowing said segment (36.2) to close the dosing compartment (36.1) and to serve as a sealing strip between said longitudinally extending wall (2) and said power output rotary hollow shaft (6); and multiple channels and grooves (6.2 and 6.3) running on the surface and inside said power output rotary hollow shaft (6) and vanes (7 & 8), delivering lubricating oil from said dosing compartment (36.1) to internal surfaces of the engine.

8. The rotatably two-stroke reciprocating valveless vane internal combustion engine according to claim 6, further comprising:

additional intake ports;

wherein each of said working chambers includes one of said additional intake ports, located on the casing (1) or on the end plates or heads (10 & 11), close to said longitudinally extending walls (2 or 3, or 2 & 3) and opposite the intake ports for assisting chamber(s) respectively;

said intake ports connected via intake tubes to opening and closing membranes;

a cavity (33) inside the top of said longitudinally extending wall (2) connected via an oil tube (34) to a container of oil (32) on the top of cylindrical casing (1);

a ball (35) floating on the surface of the oil inside said cavity (33) and closing said oil tube (34) when the amount of oil in said cavity is sufficient;

an opening (36) at a lower end of said longitudinally extending wall (2) allowing oil to leak from said cavity (33) on the flat portion (6.1) of said power output rotary hollow shaft (6), wherein said opening is narrow at the top and at the bottom, forming a dosing compartment (36.1) in the middle, and supplying the inside of the engine with exact portions of necessary lubrication;

a segment (36.2) having a pin or a bolt profile closing the top of said compartment (36.1) in a down position and opening the bottom, allowing oil to leak from said compartment (36.1) onto said flat portion (6.1) of said power output rotary hollow shaft (6) when said shaft (6) rotates;

a spring (36.3) facilitating the downward motion of said segment (36.2), allowing said segment (36.2) to close the dosing compartment (36.1) and to serve as a sealing strip between said longitudinally extending wall (2) and said power output rotary hollow shaft (6); and multiple channels and grooves (6.2 and 6.3) running on the surface and inside said power output rotary hollow shaft (6) and the vanes (7 & 8), delivering lubricating oil from said dosing compartment (36.1) to internal surfaces of the engine.

* * * * *